US006604300B2

(12) United States Patent
Meschan

(10) Patent No.: US 6,604,300 B2
(45) **Date of Patent: *Aug. 12, 2003**

(54) ATHLETIC SHOE WITH IMPROVED SOLE

(75) Inventor: David F. Meschan, Greensboro, NC (US)

(73) Assignee: Akeva L.L.C., Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/007,535

(22) Filed: Dec. 4, 2001

(65) Prior Publication Data

US 2002/0116842 A1 Aug. 29, 2002

Related U.S. Application Data

(63) Continuation of application No. 09/641,148, filed on Aug. 17, 2000, now Pat. No. 6,324,772, which is a continuation of application No. 09/512,433, filed on Feb. 25, 2000, now Pat. No. 6,195,916, which is a continuation of application No. 09/313,667, filed on May 18, 1999, now Pat. No. 6,050,002, which is a continuation of application No. 08/723,857, filed on Sep. 30, 1996, now Pat. No. 5,918,384, which is a continuation-in-part of application No. 08/291,945, filed on Aug. 17, 1994, now Pat. No. 5,560,126, which is a continuation-in-part of application No. 08/108,065, filed on Aug. 17, 1993, now Pat. No. 5,615,497.

(51) Int. Cl.[7] ..... A43B 21/32; A43B 13/48

(52) U.S. Cl. ..... 36/25 R; 36/37; 36/28; 36/27; 36/35 R

(58) Field of Search ..... 36/37, 25 R, 15, 36/100, 105, 103, 42, 31, 35 R, 35 B, 27, 28

(56) References Cited

U.S. PATENT DOCUMENTS

| | | | |
|---|---|---|---|
| 48,682 | A | 7/1865 | Hayward et al. |
| 221,592 | A | 11/1879 | Mitchell et al. |
| 485,813 | A | 11/1892 | Hooper |
| 537,492 | A | 4/1895 | Smith |
| 652,887 | A | 7/1900 | Butterfield |

(List continued on next page.)

FOREIGN PATENT DOCUMENTS

| | | |
|---|---|---|
| CH | 434 029 | 10/1967 |
| DE | 648 339 | 7/1937 |
| DE | 693 394 | 7/1940 |
| DE | 947 054 | 7/1956 |
| DE | 2 154 951 | 5/1973 |

(List continued on next page.)

OTHER PUBLICATIONS

Expert Declaration of: Jerry D. Stubblefield dated Jul. 30, 2002.

"New Footwear Concepts" by E.I. du Pont de Nemours & Co. (1988).

(List continued on next page.)

*Primary Examiner*—M. D. Patterson
(74) *Attorney, Agent, or Firm*—Martin & Ferraro, LLP

(57) ABSTRACT

A shoe has an upper, a foot support region positioned below at least a portion of the upper to support the bottom of a user's foot, a sole secured below the foot support region, and a flexible member positioned below at least a portion of the foot support region and above at least a portion of the sole. The flexible member has a top surface, a bottom surface, a peripheral portion, and an interior portion. The interior portion of the flexible member deflects in use in a direction substantially perpendicular to a major longitudinal axis of the shoe. At least a portion of the peripheral portion is restrained from movement relative to the interior portion in a direction substantially perpendicular to the major longitudinal axis of the shoe.

239 Claims, 27 Drawing Sheets

U.S. PATENT DOCUMENTS

| | | | |
|---|---|---|---|
| 674,636 | A | 5/1901 | Priestman |
| 789,089 | A | 5/1905 | Frank |
| 818,861 | A | 4/1906 | Beck et al. |
| 990,458 | A | 4/1911 | Scholl |
| 1,046,815 | A | 12/1912 | Lavoie |
| 1,062,338 | A | 5/1913 | Kane |
| 1,112,635 | A | 10/1914 | May |
| 1,316,505 | A | 5/1919 | O'Neill |
| 1,318,247 | A | 10/1919 | Victor |
| 1,346,841 | A | 7/1920 | Padden |
| 1,366,601 | A | 1/1921 | Sellars |
| 1,371,339 | A | 3/1921 | Arntz et al. |
| 1,410,064 | A | 3/1922 | Hunt |
| 1,439,757 | A | 12/1922 | Redman |
| 1,439,758 | A | 12/1922 | Redman |
| 1,444,677 | A | 2/1923 | Fischer |
| 1,458,257 | A | 6/1923 | Van Melle |
| 1,479,773 | A | 1/1924 | Craig |
| 1,501,765 | A | 7/1924 | Freese |
| 1,516,384 | A | 11/1924 | Kamada |
| 1,542,174 | A | 6/1925 | Robidoux |
| 1,611,024 | A | 12/1926 | Grimaldi |
| 1,721,714 | A | 7/1929 | Ross |
| 1,811,641 | A | 6/1931 | Marcelle |
| 2,002,087 | A | 5/1935 | Esterson |
| 2,003,646 | A | 6/1935 | De Blasio |
| 2,087,311 | A | 4/1937 | Boag |
| 2,119,807 | A | 6/1938 | Farley |
| 2,148,974 | A | 2/1939 | Wysowski |
| 2,208,260 | A | 7/1940 | Hayden |
| 2,288,168 | A | 6/1942 | Leu |
| 2,300,635 | A | 11/1942 | Shepherd |
| 2,374,954 | A | 5/1945 | Pipitone |
| 2,446,627 | A | 8/1948 | Bier |
| 2,491,280 | A | 12/1949 | Roth |
| 2,500,302 | A | 3/1950 | Vicente |
| 2,540,449 | A | 2/1951 | Kaufmann |
| 2,556,842 | A | 6/1951 | Gilmour |
| 2,607,134 | A | 8/1952 | Langer |
| 2,628,439 | A | 2/1953 | Rochlin |
| 2,707,341 | A | 5/1955 | Romano |
| 2,745,197 | A | 5/1956 | Holt |
| 2,806,302 | A | 9/1957 | Sharpe |
| 2,998,661 | A | 9/1961 | Isreal |
| 3,083,478 | A | 4/1963 | Rakus |
| 3,085,359 | A | 4/1963 | Rubens |
| 3,087,265 | A | 4/1963 | McKinley |
| 3,169,327 | A | 2/1965 | Fukuoka |
| 3,171,218 | A | 3/1965 | D'Urbano |
| 3,208,163 | A | 9/1965 | Rubens |
| 3,237,321 | A | 3/1966 | McKinley |
| 3,271,885 | A | 9/1966 | McAuliffe |
| 3,318,025 | A | 5/1967 | Antelo |
| 3,455,038 | A | 7/1969 | Kasdan |
| 3,478,447 | A | 11/1969 | Gilead |
| 3,514,879 | A | 6/1970 | Frattallone |
| 3,566,489 | A | 3/1971 | Morley |
| 3,593,436 | A | 7/1971 | Vietas |
| 3,646,497 | A | 2/1972 | Gillikin |
| 3,664,041 | A | 5/1972 | Frattallone |
| 3,775,874 | A | 12/1973 | Bonneville |
| 3,782,010 | A | 1/1974 | Frattallone |
| 3,804,099 | A | 4/1974 | Hall |
| 3,928,881 | A | 12/1975 | Bente |
| 3,988,840 | A | 11/1976 | Minihane |
| 4,043,058 | A | 8/1977 | Hollister et al. |
| 4,062,132 | A | 12/1977 | Klimaszewski |
| 4,067,123 | A | 1/1978 | Minihane |
| 4,098,011 | A | 7/1978 | Bowerman |
| 4,102,061 | A | 7/1978 | Saaristo |
| 4,168,585 | A | 9/1979 | Gleichner |
| 4,214,384 | A | 7/1980 | Gonzalez |
| 4,224,749 | A | 9/1980 | Diaz-Cano |
| 4,258,480 | A | 3/1981 | Famolare, Jr. |
| 4,262,434 | A | 4/1981 | Michelotti |
| 4,263,728 | A | 4/1981 | Frecentese |
| 4,267,650 | A | 5/1981 | Bauer |
| 4,288,929 | A | 9/1981 | Norton et al. |
| 4,320,588 | A | 3/1982 | Sottolana |
| 4,322,894 | A | 4/1982 | Dykes |
| 4,322,895 | A | 4/1982 | Hockerson |
| 4,342,158 | A | 8/1982 | McMahon et al. |
| 4,363,177 | A | 12/1982 | Boros |
| 4,372,058 | A | 2/1983 | Stubblefield |
| 4,377,042 | A | 3/1983 | Bauer |
| 4,378,643 | A | 4/1983 | Johnson |
| 4,391,048 | A | 7/1983 | Lutz |
| 4,393,605 | A | 7/1983 | Spreng |
| 4,414,763 | A | 11/1983 | Bente |
| 4,429,474 | A | 2/1984 | Metro |
| 4,449,307 | A | 5/1984 | Stubblefield |
| 4,455,765 | A | 6/1984 | Sjosward |
| 4,455,766 | A | 6/1984 | Rubens |
| 4,486,964 | A | 12/1984 | Ruby |
| 4,510,700 | A | 4/1985 | Brown |
| 4,530,173 | A | 7/1985 | Jesinsky, Jr. |
| 4,534,124 | A | 8/1985 | Schnell |
| 4,541,185 | A | 9/1985 | Chou |
| 4,546,556 | A | 10/1985 | Stubblefield |
| 4,550,510 | A | 11/1985 | Stubblefield |
| 4,561,195 | A | 12/1985 | Onoda et al. |
| 4,598,487 | A | 7/1986 | Misevich |
| 4,606,139 | A | 8/1986 | Silver |
| 4,608,768 | A | 9/1986 | Cavanagh |
| 4,610,100 | A | 9/1986 | Rhodes |
| 4,622,764 | A | 11/1986 | Bouler |
| 4,638,575 | A | 1/1987 | Illustrato |
| 4,642,917 | A | 2/1987 | Ungar |
| 4,680,876 | A | 7/1987 | Peng |
| 4,706,392 | A | 11/1987 | Yang |
| 4,709,489 | A | 12/1987 | Welter |
| 4,712,314 | A | 12/1987 | Sigoloff |
| 4,741,114 | A | 5/1988 | Stubblefield |
| 4,745,693 | A | 5/1988 | Brown |
| 4,756,095 | A | 7/1988 | Lakic |
| 4,776,109 | A | 10/1988 | Sacre |
| 4,778,717 | A | 10/1988 | Fitchmun |
| 4,785,557 | A | 11/1988 | Kelley et al. |
| 4,811,500 | A | 3/1989 | Maccano |
| 4,815,221 | A | 3/1989 | Diaz |
| 4,843,737 | A | 7/1989 | Vorderer |
| 4,845,863 | A | 7/1989 | Yung-Mao |
| 4,866,861 | A | 9/1989 | Noone |
| 4,875,300 | A | 10/1989 | Kazz |
| 4,878,300 | A | 11/1989 | Bogaty |
| 4,879,821 | A | 11/1989 | Graham et al. |
| 4,881,329 | A | 11/1989 | Crowley |
| 4,887,367 | A | 12/1989 | Mackness et al. |
| 4,936,028 | A | 6/1990 | Posacki |
| 4,979,319 | A | 12/1990 | Hayes |
| 4,995,173 | A | 2/1991 | Spier |
| 5,005,300 | A | 4/1991 | Diaz et al. |
| 5,014,449 | A | 5/1991 | Richard et al. |
| RE33,648 | E | 7/1991 | Brown |
| 5,052,130 | A | 10/1991 | Barry et al. |
| 5,070,629 | A | 12/1991 | Graham et al. |
| 5,083,385 | A | 1/1992 | Halford |
| 5,086,574 | A | 2/1992 | Bacchiocchi |
| 5,092,060 | A | 3/1992 | Frachey et al. |
| 5,179,791 | A | 1/1993 | Lain |
| 5,185,943 | A | 2/1993 | Tong et al. |

| | | | |
|---|---|---|---|
| 5,191,727 | A | 3/1993 | Barry et al. |
| 5,197,206 | A | 3/1993 | Shorten |
| 5,224,277 | A | 7/1993 | Sang Do |
| 5,255,451 | A | 10/1993 | Tong et al. |
| 5,319,866 | A | 6/1994 | Foley et al. |
| 5,325,611 | A | 7/1994 | Dyer et al. |
| 5,343,639 | A | 9/1994 | Kilgore et al. |
| 5,353,523 | A | 10/1994 | Kilgore et al. |
| 5,367,792 | A | 11/1994 | Richard et al. |
| 5,381,608 | A | 1/1995 | Claveria |
| 5,402,588 | A | 4/1995 | Graham et al. |
| 5,425,184 | A | 6/1995 | Lyden et al. |
| 5,469,638 | A | 11/1995 | Crawford, III |
| 5,528,842 | A | 6/1996 | Ricci et al. |
| 5,560,126 | A | 10/1996 | Meschan et al. |
| 5,615,497 | A | 4/1997 | Meschan |
| 5,722,186 | A | 3/1998 | Brown |
| 5,806,210 | A | 9/1998 | Meschan |
| 5,829,172 | A | 11/1998 | Kaneko |

FOREIGN PATENT DOCUMENTS

| | | |
|---|---|---|
| DE | 2 742 138 | 3/1979 |
| FR | 533 972 | 3/1922 |
| GB | 25 728 | 11/1909 |
| GB | 63342 | 2/1911 |
| GB | 83 342 | 2/1911 |
| GB | 229 884 | 3/1924 |
| GB | 1 540 926 | 2/1979 |
| GB | 2 144 024 | 2/1985 |
| JP | 62-41601 | 10/1987 |
| JP | 62-200904 | 12/1987 |
| JP | 5-18965 | 5/1993 |

OTHER PUBLICATIONS

Etoni Spring 1996 Footwear catalogue.

International Search Report for International Application PCT/US94/09001 dated Jan. 2, 1995.

Mizuno Sport Shoe Catalog (1986).

Etonic Spring Sport Shoe Catalog; p. 4; (1993).

Declaration of Takaya Kimura (Civil Action File No. 1:00 CV 00978).

Mizuno 1985 Sports Shoe catalog excerpts (MIZJP 0254–02531).

Mizuno 1986 Sports Shoe catalog excerpts (MIZJP 02532–02537).

Mizuno 1987 Athletic Footwear catalog excerpts (MIZJP 02538–02546).

Mizuno 1988 Athletic Footwear catalog excerpts (MIZJP 02547–02549).

Mizuno 1991 All Line–Up catalog excerpts (MIZJP 02550–02556).

Mizuno 1992 Run–Bird All Line–Up catalog excerpts (MIZJP 02557–02559).

Mizuno 1993 All–Line–Up catalog excerpts (MIZJP 02560–02564).

ATHLETIC SHOE WITH IMPROVED SOLE

This is a continuation of application Ser. No. 09/641,148, filed Aug. 17, 2000, now U.S Pat. No. 6,324,772, which is a continuation of application Ser. No. 09/512,433, filed Feb. 25, 2000, now U.S. Pat. No. 6,195,916, which is a continuation of application Ser. No. 09/313,667, filed May 18, 1999, now U.S. Pat. No. 6,050,002, which is a continuation of application Ser. No. 08/723,857, filed Sep. 30, 1996, now U.S. Pat. No. 5,918,384, which is a CIP of 08/291,945, filed Aug. 17, 1994, now U.S. Pat. No. 5,560,126, which is a CIP of 08/108,065, filed Aug. 17, 1993, now U.S. Pat. No. 5,615,497; all of which are incorporated herein by reference.

BACKGROUND OF THE INVENTION

1. Field of the Invention

The present invention relates generally to an improved rear sole for footwear and, more particularly, to a rear sole for an athletic shoe with an extended and more versatile life and better performance in terms of cushioning and spring.

2. Discussion of the Related Art

Athletic shoes, such as those designed for running, tennis, basketball, cross-training, hiking, walking, and other forms of exercise, typically include a laminated sole attached to a soft and pliable upper. The laminated sole generally includes a resilient rubber outsole attached to a more resilient midsole usually made of polyurethane, ethylene vinyl acetate (EVA), or a rubber compound. When laminated, the sole is attached to the upper as a one-piece structure, with the rear sole being integral with the forward sole.

One of the principal problems associated with athletic shoes is outsole wear. A user rarely has a choice of running surfaces, and asphalt and other abrasive surfaces take a tremendous toll on the outsole. This problem is exacerbated by the fact that most pronounced outsole wear, on running shoes in particular, occurs principally in two places: the outer periphery of the heel and the ball of the foot, with peripheral heel wear being, by far, a more acute problem. In fact, the heel typically wears out much faster than the rest of a running shoe, thus requiring replacement of the entire shoe even though the bulk of the shoe is still in satisfactory condition.

Midsole compression, particularly in the case of athletic shoes, is another acute problem. As previously noted, the midsole is generally made of a resilient material to provide cushioning for the user. However, after repeated use, the midsole becomes compressed due to the large forces exerted on it, thereby causing it to lose its cushioning effect. Midsole compression is the worst in the heel area, including the area directly under the user's heel bone and the area directly above the peripheral outsole wear spot.

Despite technological advancements in recent years in midsole design and construction, the benefits of such advancements can still be largely negated, particularly in the heel area, by two months of regular use. The problems become costly for the user since athletic shoes are becoming more expensive each year, with some top-of-the-line models priced at over $150.00 a pair. By contrast, with dress shoes, whose heels can be replaced at nominal cost over and over again, the heel area (midsole and outsole) of conventional athletic shoes cannot be. To date, there is nothing in the art that successfully addresses the problem of midsole compression in athletic shoes, and this problem remains especially severe in the heel area of such shoes.

Another problem is that purchasers of conventional athletic shoes cannot customize the cushioning or spring in the heel of a shoe to their own body weight, personal preference, or need. They are "stuck" with whatever a manufacturer happens to provide in their shoe size.

Finally, there appear to be relatively few, if any, footwear options available to those persons suffering from foot or leg irregularities, foot or leg injuries, and legs of different lengths, among other things, where there is a need for the left and right rear soles to be of a different height and/or different cushioning or spring properties. Presently, such options appear to include only custom-made shoes that are prohibitively expensive and rendered useless if the person's condition improves or deteriorates.

SUMMARY OF THE INVENTION

The present invention is directed to a shoe that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the shoes and shoe systems particularly pointed out in the written description and claims, as well as the appended drawings.

To achieve these and other advantages and in accordance with the purpose of the invention, as embodied and broadly described herein, the shoe includes an upper having a heel region, a rear sole secured below the heel region of the upper, and a rear sole support attached to the upper and configured to secure the rear sole below the heel region of the upper. The rear sole support includes a flexible region positioned below the heel region of the upper and above a portion of the rear sole. The flexible region is sufficiently stiff to support a user while still being sufficiently flexible to flex and spring when the user runs or walks vigorously. The flexible region has an interior portion which in its normal, unflexed state is spaced upwardly from the portion of thy rear sole immediately below said interior portion, the interior portion being adapted to flex in a direction substantially perpendicular to the major longitudinal axis of the shoe as it is used.

The interior portion of the flexible region preferably is elevated relative to its peripheral portion in a direction toward the heel region of the upper. In certain embodiments the flexible region is an integral part of the rear sole support. The rear sole support may include an integral arch extension extending below the upper from a position proximate the heel region of the upper through a substantial portion of the arch region of the upper to support the arch region.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE PREFERRED EMBODIMENTS

Figure 1:
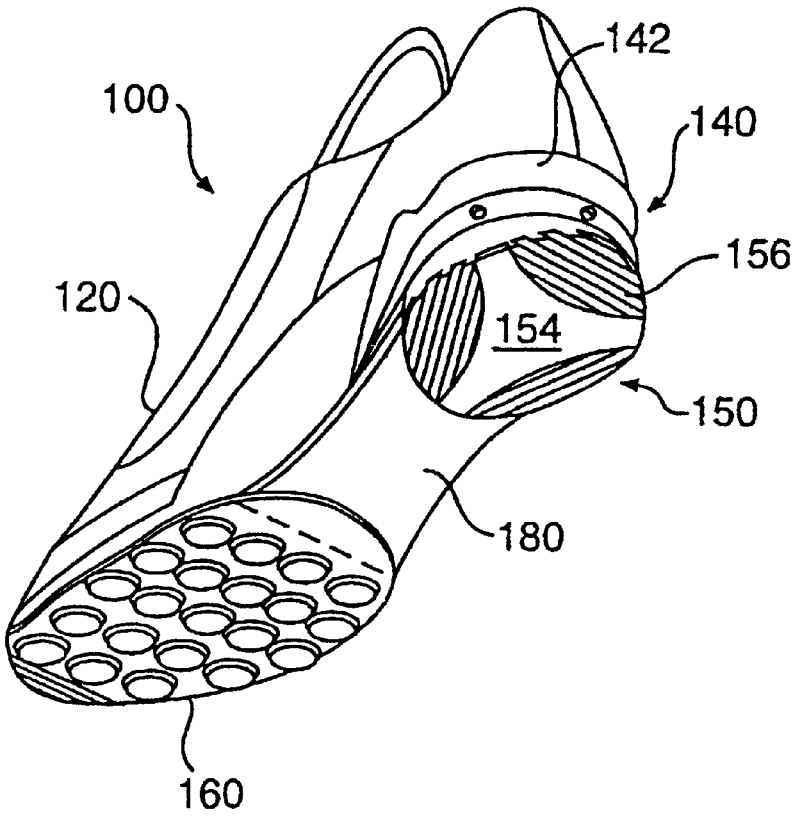
FIG. 1 is an isometric view of an embodiment of the shoe of the present invention.

Reference will now be made in detail to the present preferred embodiments of the invention, examples of which are illustrated in the accompanying drawings. Wherever possible, the same reference characters will be used throughout the drawings to refer to the same or like parts.

FIG. 1 illustrates a first embodiment of the shoe of the present invention. The shoe, designated generally as 100, has a shoe upper 120, rear sole support 140, a rear sole 150, and a forward sole 160. Shoe 100 also preferably includes a flexible member 200 (FIG. 2) positioned between rear sole 150 and a heel region of upper 120. The flexible member provides spring to the user's gait cycle upon heel strike and reduces or eliminates interior rear midsole compression in that it is more durable than conventional midsole material.

Upper 120 may be composed of a soft, pliable material that covers the top and sides of the user's foot during use. Leather, nylon, and other synthetics are examples of the various types of materials known in the art for shoe uppers. The particular construction of the upper is not critical to the shoe of the present invention. It may even be constructed as a sandal or may be made of molded plastic, integral with the rear sole support, as in the case of ski boots or roller blade uppers.

Forward sole 160 is attached to upper 120 in a conventional manner, typically by injection molding, stitching, or gluing. Forward sole 160 typically includes two layers: an elastomeric midsole laminated to an abrasion-resistant outsole. The particular construction of the forward sole is not critical to the invention and various configurations may be used. For example, the midsole may be composed of material such as polyurethane or ethylene vinyl acetate (EVA) and may include air bladders or gel-filled tubes encased therein, and the outsole may be composed of, by means of example only, an abrasion-resistant rubber compound.

Figure 2:
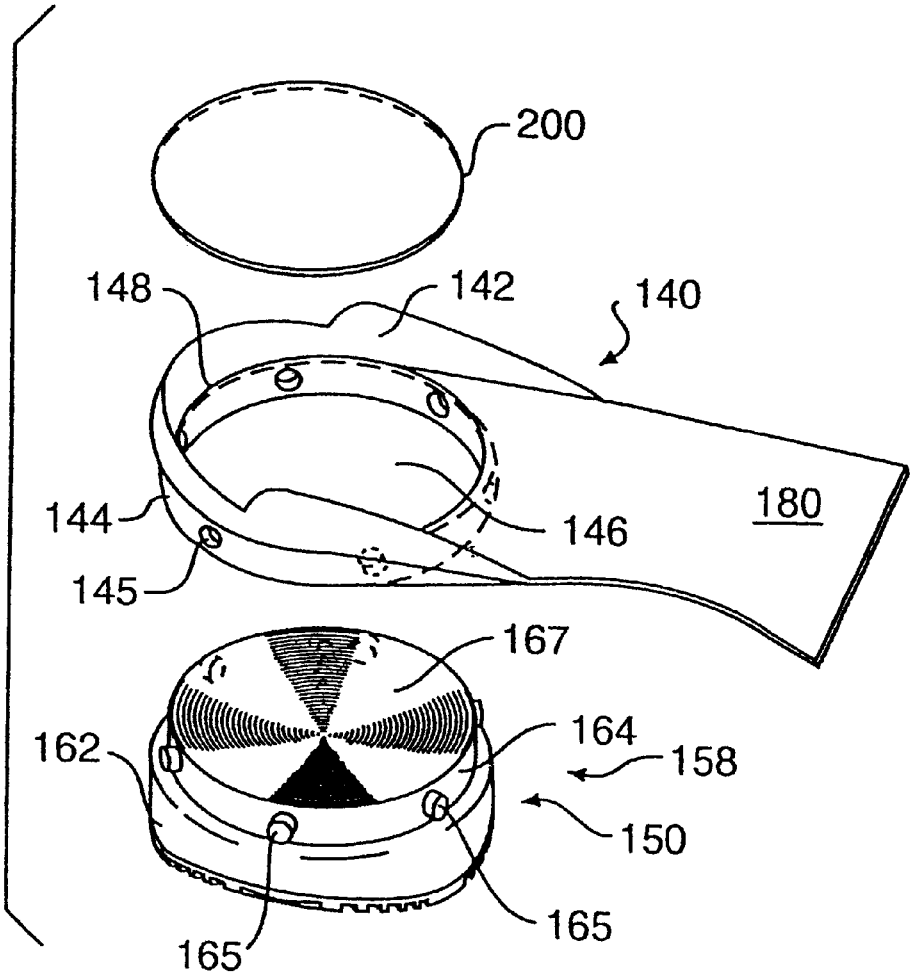
FIG. 2 is an exploded isometric view of a rear sole support, flexible member, and rear sole for the shoe of FIG. 1.

Rear sole support 140 is also attached to the heel region of upper 120 in a conventional manner, such as injection molding, stitching, or gluing. Rear sole support 140 is substantially rigid and is configured to stabilize the heel region of upper 120 and secure rear sole 150 below the heel region. As shown in FIG. 2, rear sole support 140 may include an upwardly extending wall 142, referred to as a heel counter, that surrounds the periphery of the heel region of upper 120 to provide lateral stabilization. Wall 142 preferably surrounds the rear and sides of upper 120 proximate the heel region and in service supports and stabilizes the user's heel as he or she runs. Rear sole support 140 also includes a downwardly extending side wall 144 that defines a recess 146 sized to receive a portion of rear sole 150, preferably a rear sole which is removable and rotatable to several predetermined positions. Wall 144 shown in FIG. 2 is generally circular and securely contains and holds rear sole 150. A plurality of openings 145 is formed in wall 144 to facilitate securement of rear sole 150 to rear sole support 140. The components of rear sole support 140 are preferably made integral through injection molding or other conventional techniques and are preferably composed of plastic, such as a durable plastic manufactured under the name PEBAX. It is further contemplated that the rear sole support can be made from a variety of materials, including without limitation other injection-molded thermoplastic engineering resins.

As shown in FIGS. 1 and 2, rear sole support 140 may include an arch extension or support 180 to provide a firm support for the arch of the foot and to alleviate potential gapping problems where sole support wall 144 would be adjacent forward sole 160. Arch extension 180 generally extends below upper 120 from the forward portion of side wall 144, through the arch region. It may extend as far as the ball of the foot. It is attached to upper 120 and forward sole 160 by gluing or other conventional methods. Arch extension 180 may be composed of the same material as the rear sole support and made integral with rear sole support 140 by injection molding. Alternatively, it may be made of the same or a different stiff but flexible material (such as carbon or fiberglass ribbons in a resin binder) and glued to rear sole support 140. Such one-piece construction of the arch extension together with the rear sole support solves another major problem, namely the tendency of an athletic shoe of conventional resilient material in the arch area to curl at the juncture of the substantially rigid rear sole support with the resilient forward sole.

Shoe 100 also includes a rear sole 150 that is detachably secured to and/or rotatably positionable relative to rear sole support 140. Rear sole 150, as shown in FIG. 1, includes a rubber ground-engaging outsole 154 containing a planar area and three beveled segments or portions that soften heel strike during use. As shown, the beveled segments or portions formed on the outsole have the same shape and configuration and are positioned symmetrically about the periphery of the outside and preferably symmetrically positioned about the center of rear sole 150. As explained in more detail, rear sole 150 and the attachment features that permit rear sole 150 to be placed and locked into different positions relative to rear sole support 140 are designed and configured so that one symmetrically located beveled portion can be moved into the position previously occupied by another beveled portion. As a result, as one of the beveled portions begins to wear, rear sole 150 can be repositioned to place an unworn beveled portion in the area of the shoe where there is greater wear for a particular user. By periodically altering the position of the sole before any beveled portion is badly worn, (or any midsole material directly above the bevel is badly compressed) the life and effectiveness of the rear sole, and the entire shoe, can be significantly increased. Moreover, after a given rear sole wears beyond its point of usefulness, it can be replaced with a new sole with the same or different characteristics. Prior to replacement, it is also possible that left and right rear soles may be exchanged with each other inasmuch as left and right rear soles often exhibit opposite wear patterns.

As shown in FIG. 2, rear sole 150 also includes a midsole 158 laminated to outsole 154. Midsole 158 includes a substantially cylindrical lower portion 162 and a substantially cylindrical upper portion 164 that is smaller in diameter than lower portion 162. Upper portion 164 includes a plurality of resilient knobs 165 that mate with openings 145 in rear sole support 140. As shown, the resilient knobs 165 and openings 145 are symmetrically positioned about the central axis of midsole 158 and the recess of rear sole support 140, respectively. To secure rear sole 150 to rear sole support 140, rear sole 150 is simply press-fitted into recess 146 until knobs 165 engage corresponding openings 145. This manner of locking rear sole 150 into the shoe at any one of several positions is one of several mechanical ways in which the rear sole can be removed, repositioned, and/or locked to the rear sole support or other part of a shoe.

In the embodiment shown in FIG. 2, upper midsole portion 164 has a diameter at least equal to and preferably slightly larger than that of the recess into which it fits. Midsole portion 162 has a diameter substantially equal to the diameter defined by the exterior portion of circular wall 144. This configuration of elements eliminates any vertical gapping problems from occurring between the wall of the rear sole support and the peripheral surface of the rear sole.

The inside diameter of a circular recess 146, as measured between the inside surfaces of its sidewalls, or the distance between the inside surface of a medial sidewall and the inside surface of an opposite lateral sidewall in the case of a non-circular recess (not shown), may actually be greater than the width of the heel region of the shoe upper as measured from the exterior surface of the medial side of the heel region of the upper to the exterior surface of the lateral side of the heel region of the upper (i.e., the heel region of the upper at its widest point). This is possible because the material used to make the rear sole support 140 and side walls is sufficiently strong and durable to permit the side walls to "flare out" to a greater width than the heel region of the upper without risk of breakage. This in turn permits the use of a larger rear sole 150 with more ground-engaging surface and, hence, more stability. (As stated, the exterior walls of the lower portion of the rear sole generally align vertically with the exterior surface of the side walls forming the recess 146). It also permits the employment of a flexible region or member with a correspondingly larger diameter, width or length because its peripheral edges optimally should align vertically with the load-bearing side walls of the recess. Such a larger flexible region or member, with a diameter, width or length greater than the width of the heel region of the upper at its widest point, creates more cushioning and/or spring for the user's heel during the gait cycle. The observations and provisions contained in this paragraph are equally applicable to the embodiments described in FIGS. 1, 2, and 3.

Rear sole 150 is preferably made from two different materials: an abrasion-resistant rubber compound for ground-engaging outsole 154; and a softer, more elastomeric material such as polyurethane or ethylene vinyl acetate (EVA) for midsole 158. However, rear sole 150 could be comprised of a single homogenous material, or two materials (e.g., EVA enveloped by hard rubber), as well as a material comprising air encapsulating tubes, for example, disclosed in U.S. Pat. No. 5,005,300. For each of the discussed rear sole embodiments, the outsole and midsole materials are preferably more resilient than materials used for the rear sole support or arch extension.

Detachability of rear sole 150 allows the user to change rear soles entirely when either the sole is worn to a significant degree or the user desires a different sole for desired performance characteristics for specific athletic endeavors or playing surfaces. The user can rotate the rear sole to relocate a worm section to a less critical area of the sole, and eventually replace the rear sole altogether when the sole is excessively worn. By periodically changing the position of the rear sole, more uniform wear and long life (both outsole and midsole) can be achieved. Additional longevity in wear may also be achieved by interchanging removable rear soles as between the right and left shoes, which typically exhibit opposite wear patterns.

In addition, some users will prefer to change the rear soles not because of adverse wear patterns, but because of a desire for different performance characteristics or playing surfaces. For example, it is contemplated that a person using this invention in a shoe marketed as a "cross-trainer" may desire one type of rear sole for one sport, such as basketball, and another type of rear sole for another, such as running. A basketball player might require a harder and firmer rear sole for stability where quick, lateral movement is essential, whereas a runner or jogger might tend to favor increased shock absorption features achievable from a softer, more cushioned heel. Similarly, a jogger planning a run outside on rough asphalt or cement might prefer a more resilient rear sole than the type that would be suitable to run on an already resilient indoor wooden track. Rear sole performance may also depend on the weight of the user or the amount or type of cushioning desired.

The present invention includes a shoe or shoe kit which includes or can accept a plurality of rear soles 150 having different characteristics and/or surface configurations, thereby providing a cross trainer shoe. As explained in more detail below, the shoe can also be designed to accept and use different flexible members in the rear sole area, to achieve optimal flex and cushioning, through the combination of a flexible member and rear sole selected to provide the most desirable flex, cushion, wear, support, and traction for a given application. In a preferred embodiment, both the rear sole and the flexible member are replaceable and a given rear sole can be locked in a plurality of separate positions relative to the recess in which it is held.

Since rear sole 150 shown in FIGS. 1 and 2 is selectively positionable relative to rear sole support 140 in a single plane about an axis perpendicular to the major longitudinal axis of the shoe, it may be moved to a plurality of positions with a means provided to allow the user to secure the rear sole at each desired position. After a period of use, outsole 154 will exhibit a wear pattern at the point in which the heel first contacts the ground, when the user is running, for example. Excessive wear normally occurs at this point, and at midsole 158 generally above this point, degrading the performance of the rear sole. When the user determines that the wear in this area is significant, the user can rotate the rear sole so that the worn portion will no longer be in the location of the user's first heel strike. For the shoe shown in FIGS. 1 and 2, rotation is accomplished by-detaching the rear sole and reattaching at the desired location. For the embodiment in FIG. 3 discussed below, the rear sole may be rotated without separating it from the rear sole support. The number of positions into which rear sole of FIGS. 1 and 2 can be rotated is limited by the number of knobs/openings, but is unlimited for the rear sole shown in FIG. 3. The use of other mechanical locking systems to allow selective movement and locking of the rear sole is contemplated within the spirit of the invention.

Rotating the rear sole about an axis normal to the shoe's major axis to a position, for example, 180 degrees beyond its starting point, will locate the worn portion of the rear sole at or near the instep portion of the shoe. The instep portion is an area of less importance for tractioning, stability, cushioning and shock absorbing purposes. As long as the worn portion of the rear sole is rotated beyond the area of the initial heel strike, prolonged use of the rear sole is possible. The user can continue periodically to rotate the rear sole so that an unworn portion of the rear sole is located in the area of the first heel strike.

The shape of rear sole can be circular, polygonal, elliptical, "sand-dollar," elongated "sand-dollar," or otherwise. The shape of recess 146 is formed to be compatible with the shape of the rear sole. In all embodiments, the invention includes mechanical means for selectively locking the rear sole relative to the rear sole support and upper of the shoe. Preferably, the rear sole is shaped so that at least the rear edge of the outsole has a substantially identical profile at several, or preferably each rotated position. To allow for a plurality of rotatable positions, the shape of the outsole preferably should be symmetrical about its central axis. As shown in FIG. 1, the rear sole has free beveled portions which are symmetrically positioned about its central axis. The user in this embodiment can rotate the rear sole 120° and place an unworn beveled portion at the rear heel region of the shoe, where wear is often maximum. Alternatively, the rear sole could have two beveled portions, 180° apart (in an oval embodiment this would have to be the case), in which event only one rotation per shoe, plus an exchange between right and left rear soles, would be possible, before replacement of rear soles would be necessary.

While the above discussion is directed towards a rear sole that rotates or separates in its entirety, it is specifically contemplated that the same benefits of this invention can be achieved if only a portion of the rear sole is rotatable or removable. For example, a portion of the rear sole, e.g., the center area, may remain stationary while the periphery of the ground-engaging surface or outsole rotates and/or is detachable. As another example, the rear sole may not be removable but only rotatably positionable.

In a preferred embodiment of the invention, the shoe of the present invention includes a flexible region 200 that is positioned above the rear sole and has a central portion that in its normal unflexed state is spaced upwardly from the portion of the shoe (rear sole support, or rear sole) immediately below it. The flexible region 200 is designed to provide a preselected degree of flex, cushioning, and spring, to thereby reduce or eliminate heel-center midsole compression found in conventional materials. Flexible region 200 is made of stiff, but flexible, material. Examples of materials that may be used in the manufacture of flexible member 200 include the following: graphite; fiberglass; graphite (carbon) fibers set in a resin (i.e. acrylic resin) binder; fiberglass fibers set in a resin (i.e. acrylic resin) binder; a combination of graphite (carbon) fibers and fiberglass fibers set in a resin (i.e. acrylic resin) binder; nylon; glass-filled nylon; epoxy; polypropylene; polyethylene; acrylonitrile butadiene styrene (ABS); other types of injection-molded thermoplastic engineering resins; spring steel; and stainless spring steel. The flexible region 200 can be incorporated into other elements of the shoe or can be a separate flexible member or plate.

As shown in FIG. 2, flexible member 200 can be in the form of a plate supported at its peripheral region by an upward facing top surface of rear sole support 140. In this embodiment, the member, or plate 200 is positioned between the rear sole 150 and the heel portion of upper 120. A ledge 148 may be formed in rear sole support 140 to support and laterally stabilize flexible member 200.

The flexible member may also be permanently attached to the top or bottom of the rear sole support or detachably secured to the shoe upper and removable through a pocket formed in the material (not shown) typically located on the bottom surface of the upper, or it can be exposed and removed after removing the sock liner or after lifting the rear portion of the sock liner. Alternatively, it may be totally exposed as in the case of flexible member 200 shown in FIG. 18, wherein the U-shaped cushioning member may have direct contact with the users heel without an intervening sock liner in the heel portion of the shoe. The removability of the flexible member allows the use of several different types of flexible members of varying stiffness or composition and, therefore, can be adapted according to the weight of the runner, the ability of the runner, the type of exercise involved, or the amount of cushioning and/or spring desired in the heel of the shoe.

Rear sole 150 may have a concave top surface 167, as shown in FIG. 2. Therefore, when the rear sole is attached to the rear sole support, the top surface of the rear sole does not come into contact with the flexible member when the flexible member deflects within its designed range of flex. As a result, the middle of the flexible member can flex under the weight of the user without being impeded by rear sole 150. Flexible member 200 thus acts like a trampoline to provide extra spring in the user's gait in addition to minimizing, or preventing, midsole compression in the central portion of the rear sole.

Figure 3:
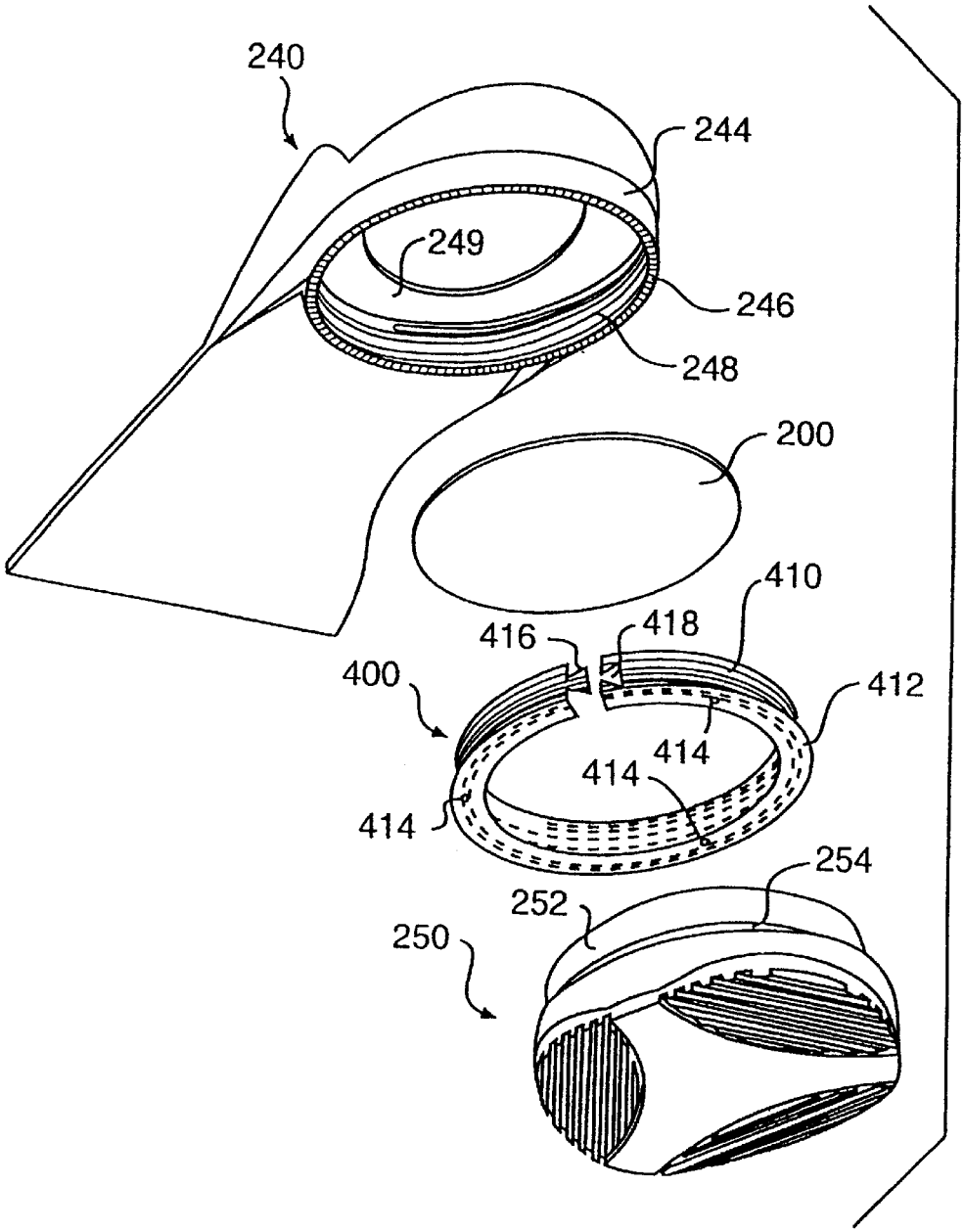
FIG. 3 is an exploded isometric view of another embodiment of a rear sole support, flexible member, and rear sole for use in the shoe of the present invention.

A second preferred embodiment is shown in FIG. 3. In this embodiment, a rear sole 250 is identical to rear sole 150 shown in FIG. 2 except that it has a groove 254 below upper midsole portion 252, instead of knobs 165. A rear sole support 240 includes a downwardly extending wall 244 that has a serrated bottom edge 246 and a threaded inner surface 248. Rear sole support 240 also includes an upper rim 249.

The embodiment of FIG. 3 also indicates a threaded ring 400. Ring 400 includes a threaded outer su 410 that mates with threaded inner surface 248 of rear sole support 240. The ring also includes an outwardly and inwardly extending flange 412 that presses against serrated bottom edge 246 when the ring is screwed into the rear sole support. The bottom surface of flange 412 includes anchors 414, and may also be serrated to further grip the rear sole to prevent rotation. The ring also has two ends 416 and 418, and end 416 may have a male member and end 418 may be shaped to receive the male member to lock the two ends together. Ring 400 may be made of hard plastic or other substantially rigid materials that provide a secure engagement with rear sole support 240 and a firm foundation for supporting flexible member 200.

Rear sole 250 is attached to rear sole support 240 by unlocking the ends of ring 400 and positioning ring 400 around upper midsole portion 252 of the rear sole such that flange 412 engages groove 254. Ring 400 is then firmly locked onto the rear sole by mating end 416 with end 418. Flexible member 200 is inserted into the rear sole support so that it presses against upper rim 249. Ring 400, with rear sole 250 attached, is then screwed into the rear sole support by engaging threaded surface 410 of the ring with threaded surface 248 of wall 244. The ring is then screwed into the rear sole support until serrated edge 246 of wall 244 engages flange 412 of ring 400. Serrated edge 246 serves to prevent rotation of the ring during use and the top edge of ring 400 firmly supports flexible member 200.

The rear sole support sidewalls need not be continuous around the entire recess. Such sidewalls may be substantially eliminated on the lateral and medial sides of the rear sole support, or even at the rear and/or front of the rear sole support, exposing ring 400 when installed, even allowing it to protrude through the sidewalls where the openings are created This has no effect whatsoever on the thread alignment on the inside surface of the remaining sidewalls. The advantage of doing this is that a ring with a slightly larger diameter than otherwise possible and, hence, a flexible member with a slightly larger diameter than otherwise possible may be employed.

In the embodiment shown in FIG. 3, a variety of different flexible members 200 having different flex and cushioning characteristics can be selectively incorporated into the shoe. Flexible member 200, once incorporated into the shoe, is securely held in place with rear sole support 240. Preferably, the rear sole support contacts flexible member 200 only along its outer periphery, and rear sole support 240 includes an opening above the flexible member, thereby permitting the plate to protrude upwardly toward the user's heel. Moreover, because the top surface of rear sole 250 is preferably concave in shape, the central portion of the rear sole does not contact the central portion of the flexible member in its unflexed, normal position. As a result, the flexible member can also flex downward. The degree of flexing of the member can be controlled both by the selection of the material and shape of the member, as well as the relative dimensions and shape of rear sole support 240 and rear sole 250. While flexible member 200 and the corresponding recess in rear sole support 240 are circular in FIG. 3, other shapes can be utilized. Rear sole support 240 could be designed to include a recess above upper rim 249 to accept the flexible member and a mechanical means, such as a circular locking ring, similar to ring 400, to support and lock the flexible member in place. In such an embodiment, the user could change the flexible member from the inside of the shoe. Similarly, the flexible member 200 could be fixedly secured to, or incorporated as an integral part, of either the rear sole support or the rear sole. Similar configurations of an integral flexible region are within the spirit of the invention.

The embodiment of FIG. 3 and other embodiments of the invention preferably provide a shoe that includes a flexible region or member which has its own preselected spring and cushioning characteristic and which is preferably removable and replaceable, a rear sole with its own pre-selected cushioning properties (both outsole and midsole) and which is preferably removable, replaceable, and capable of being locked in place at a plurality of preselected positions; a plurality of beveled portions on the outer surface of the rear sole which are preferably symmetrically located about its axis; and an interrelationship of the flexible member, rear sole support, and rear sole which permit the flexible member to freely flex to at least a predetermined degree. The flexible region and its characteristics, the rear sole and its characteristics, and the rear sole's relative location to the flexible region can be selectively altered, to provide in combination an optimal shoe for a given application. Also, because of the rear sole rotation and replacement permitted by the invention, typically heavy outsole material may be made thinner than on conventional athletic shoes, thus reducing the weight of the shoe. The invention also permits the weight of the shoe to be further reduced because the central portion of the midsole of the rear sole can be eliminated, since the flexible region of the shoe provides weight bearing and cushioning at this area Other rear sole support/rear sole combinations for securing the rear sole to the shoe and for supporting the flexible member at or below the heel region of the upper are contemplated and fall within the spirit of this invention, as described and claimed. By means of example only, some such additional configurations are disclosed in commonly-owned U.S. patent application Ser. No. 08/291,945, which is incorporated herein by reference.

The flexible region of the present invention is not limited to a circular shape and can be adapted to conform to the shape of the rear sole. The flexible region also need not be used only in conjunction with a detachable rear sole, but can be used with permanently attached rear soles as well.

FIGS. 4–17 show various alternative embodiments of the flexible member. In each of these embodiments, the flexible member may be curved or convex in shape, or have an inwardly curved or concave bottom surface, such that the interior portion of the flexible member is elevated relative to its periphery when the flexible member is positioned in the shoe in its normal position. Each of the following flexible member embodiments may be used in conjunction with the rear sole support/rear sole combinations disclosed in FIGS. 1–3 and more generally disclosed in this disclosure in its entirety. In addition the following disclosed embodiments of flexible members can be integrally incorporated into a portion of the shoe. In either even t, the resultant shoe has a flexible region which provides a preselected flex and spring.

Figure 4:
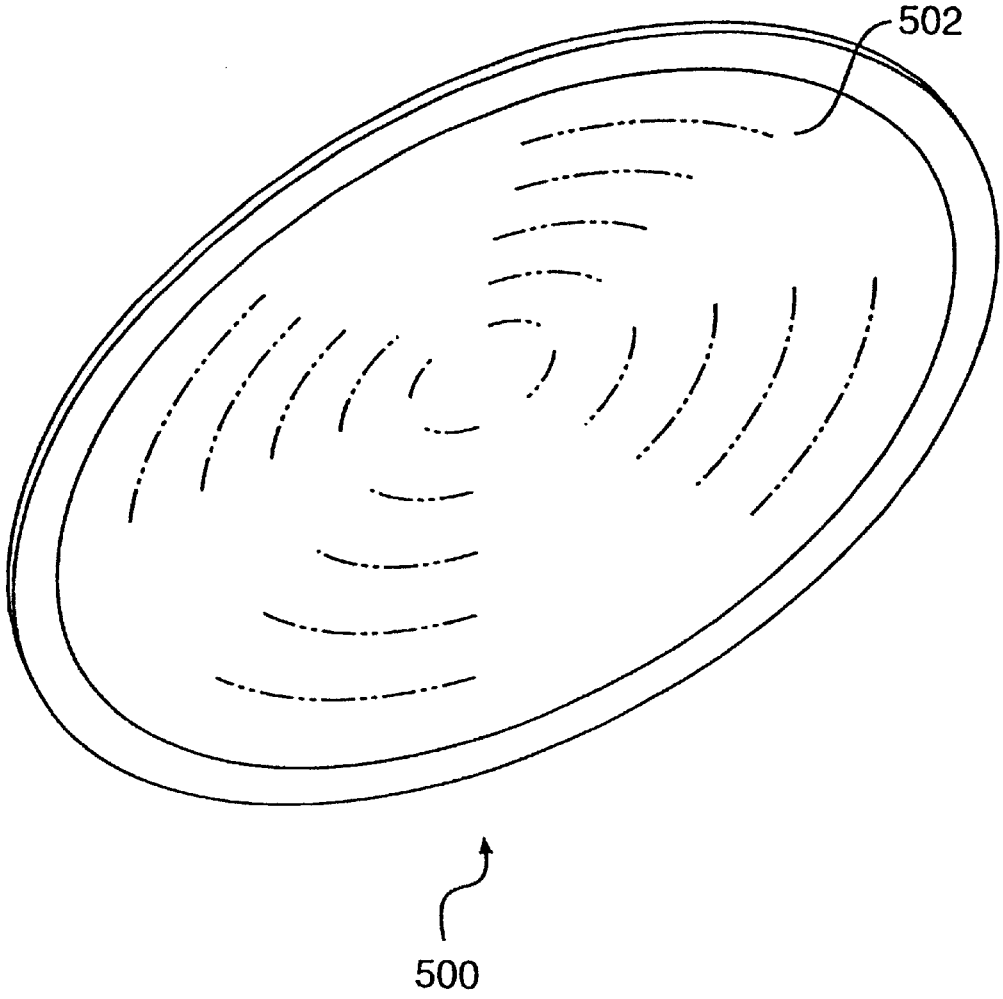
FIGS. 4–18 are isometric views of exemplary flexible member embodiments for use in the shoe of the present invention.
Figure 5:
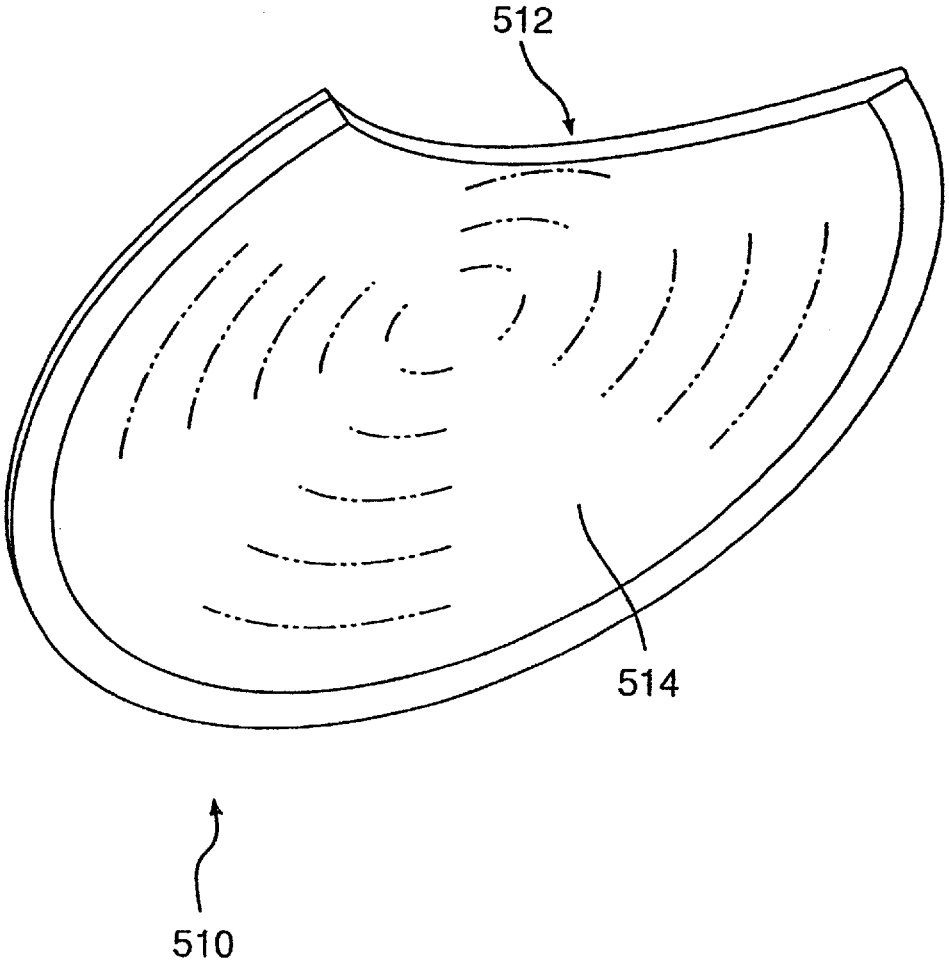

As shown in FIG. 4, flexible member 500 has a concave under surface 502 (when viewed from its bottom) and an opposing convex upper surface, and is circular in shape. As a result, the interior portion of the flexible member 500 is elevated relative to its peripheral portion and is positioned below the rear sole of the user when supported in the shoe.

Figure 6:
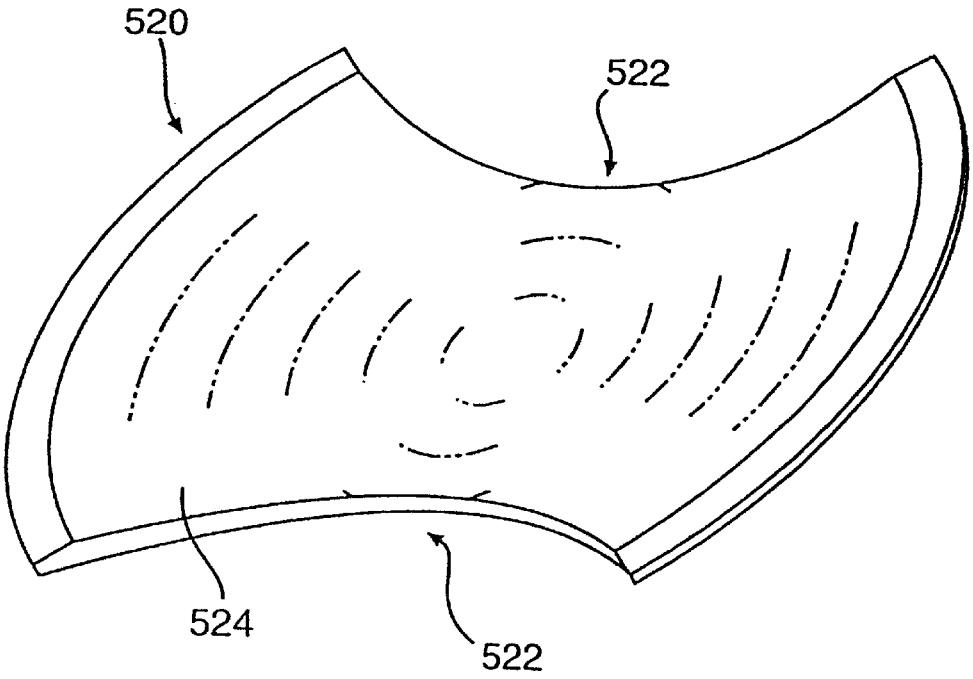
Figure 7:
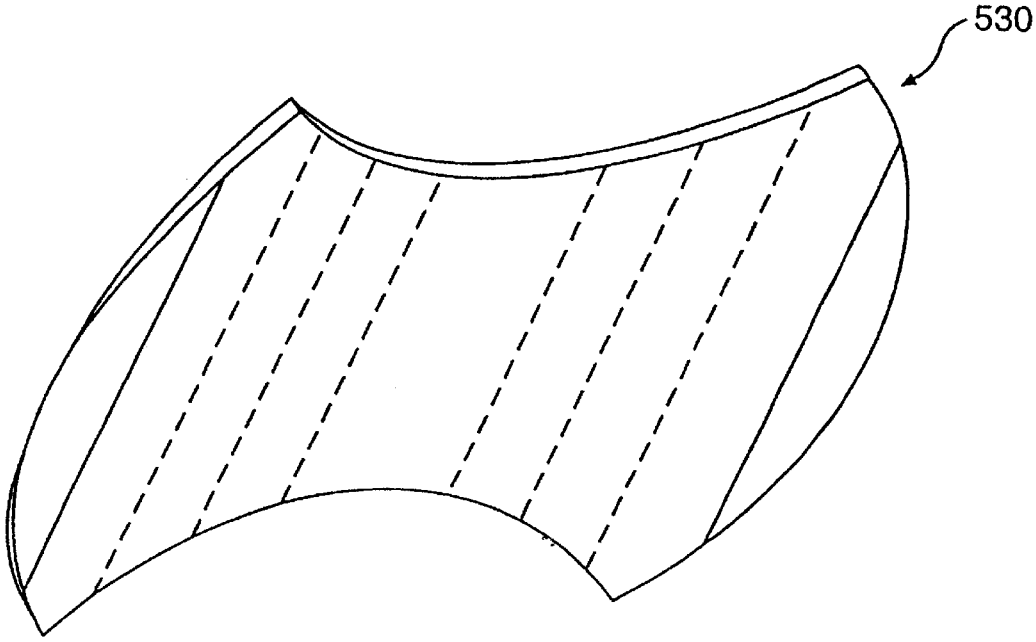

Flexible members 510 and 520 shown in FIGS. 1 and 6, respectively, are similar in structure to flexible member 500 except that flexible member 510 has a bottom surface 514 and a moon-shaped notch 512 and flexible member 520 has a bottom surface 524 and two opposing moon-shaped notches 522. Notch 512 of flexible member 510 is preferably aligned with the back of the rear sole. One of notches 522 of flexible member 520 may be aligned with the back of the rear sole, or alternatively such notches may be aligned with the lateral and medial sides of the shoe. Flexible member 530 as shown in FIG. 7 is identical in structure to flexible member 520 shown in FIG. 6 except that it is not convex in shape, but rather curved in only one direction. The flexible member 530 alignment options are the same as those of flexible member 520.

Figure 8:
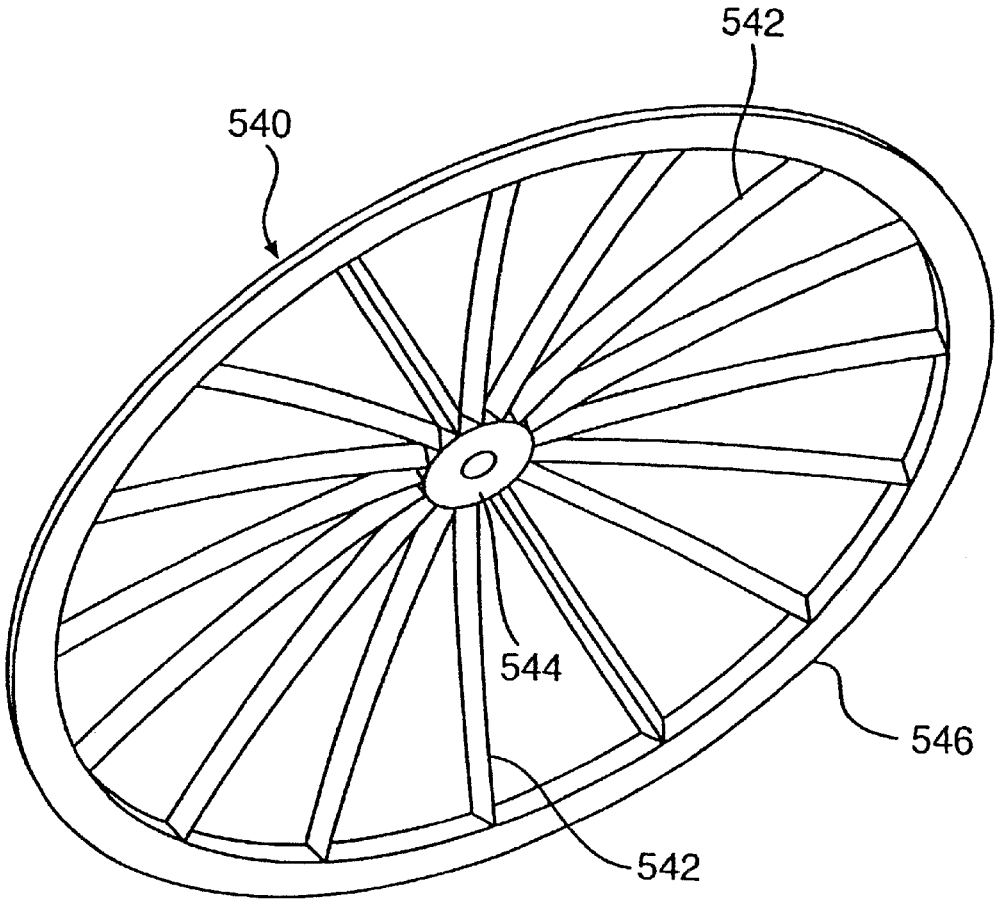

As shown in FIG. 8, flexible member 540 includes a plurality of spokes 542 each joined at one end to a hub 544 and joined at an opposite end to rim 546. The size, shape, and number of spokes is variable depending on the desired flexibility. As shown in FIG. 8, each of spokes 542 has a triangular cross-section, although the cross-section may also be square, rectangular, or any other geometrical shape. When positioned in the shoe, hub 544 is elevated relative to rim 546 such that hub 544 is closer to the heel region of the upper.

Figure 9:
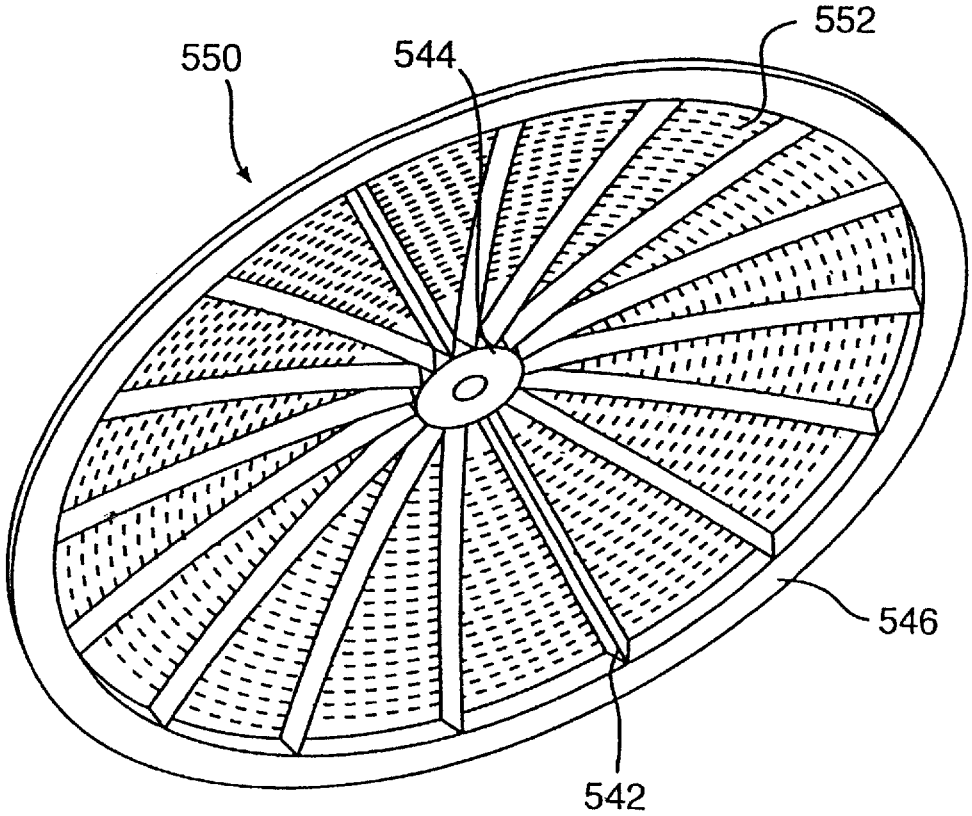
Figure 10:
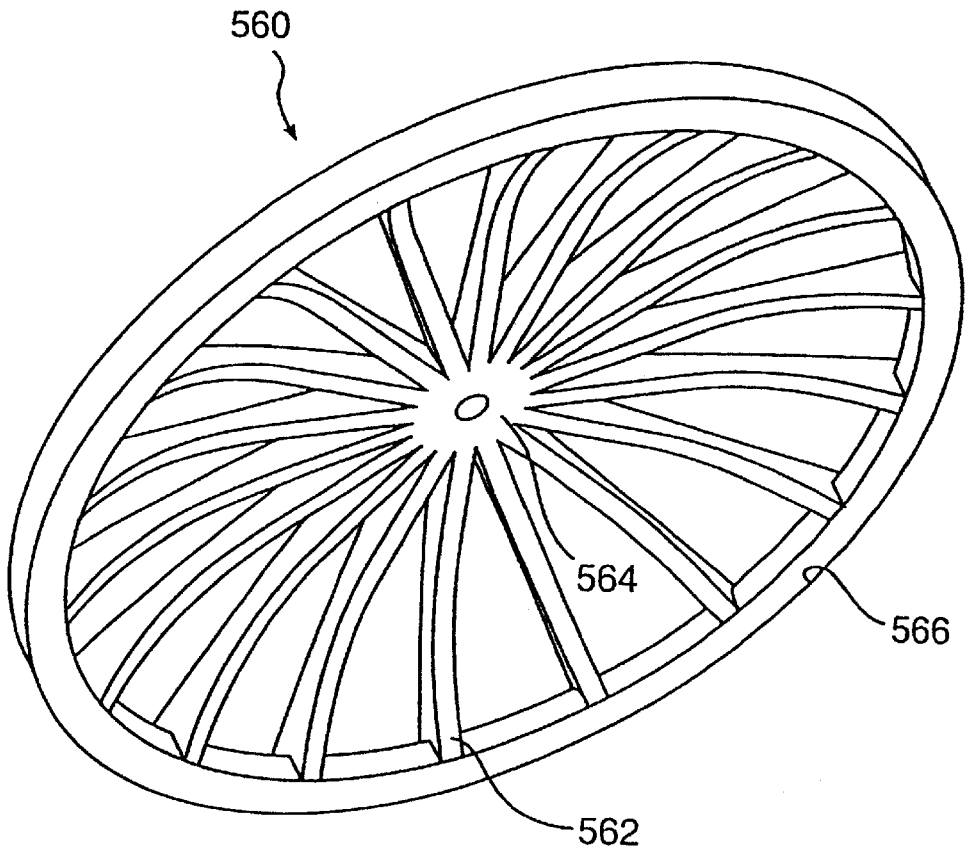

The flexible members shown in FIGS. 9–12 are variations of flexible member 540 shown in FIG. 8. Flexible member 550 shown in FIG. 9 is identical in structure to flexible member 540, but includes webbing 552 covering the top surface of flexible member 550 and joining each of spokes 542 to reinforce flexible member 550. Webbing 552 may be injection molded with the rest of flexible member. Flexible member 560 shown in FIG. 10 is similar in structure to flexible member 540 shown in FIG. 8; however, spokes 562 decrease in thickness between hub 564 and the central portion of each of the spokes 562 and then increase in thickness from the central portion toward rim 566.

Figure 11:
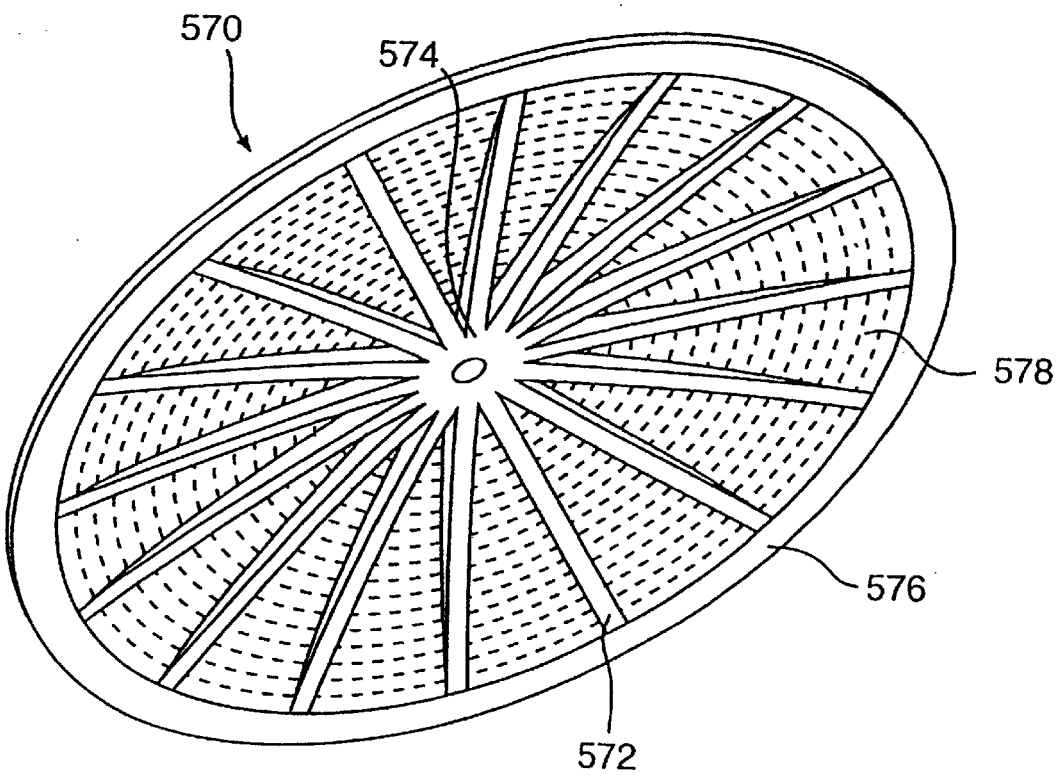

Flexible member 570, shown in FIG. 11, also includes a plurality of spokes 572 joined at opposite ends to hub 574 and rim 576. In this embodiment, the thickness of the spokes decreases in a direction from hub 574 toward rim 576. In addition, webbing 578 may be placed over the top surface of flexible member 570 similar to that disclosed in FIG. 9.

Figure 12:
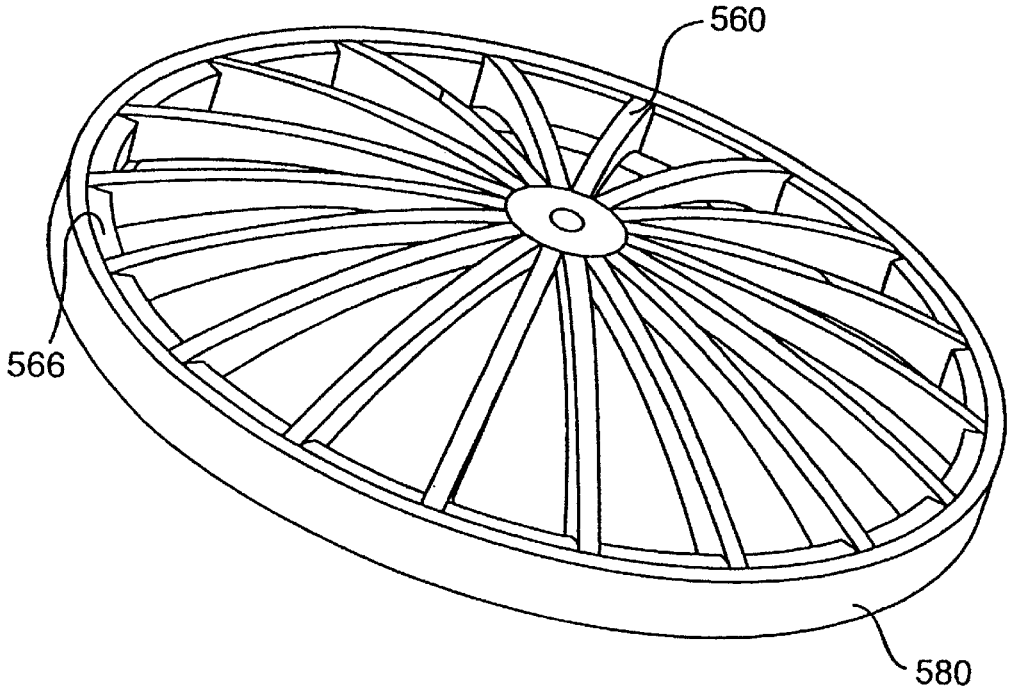

FIG. 12 illustrates a housing 580 for supporting the flexible member, in this example, flexible member 560. Housing 580 has an L-shaped cross-section to support the bottom and side surfaces of rim 566. Housing 580 may be inserted into the shoe heel with flexible member 560 or may be permanently affixed to the rear sole support. In either case, housing 580 acts as a reinforcement for limiting or eliminating lateral movement of flexible member 560 during use. This may have the effect of making the center of the flexible member more springy. It may also allow the member to be made of thinner and/or lighter weight material.

Figure 13:
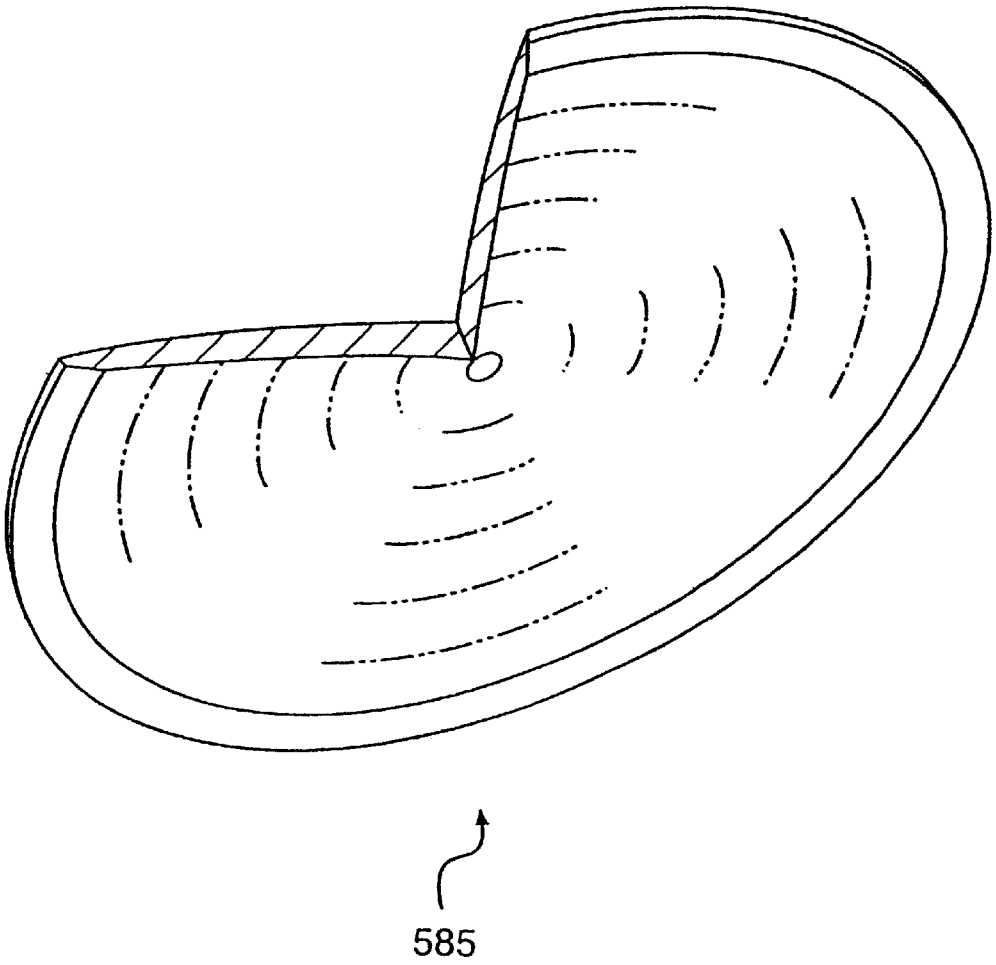
Figure 14:
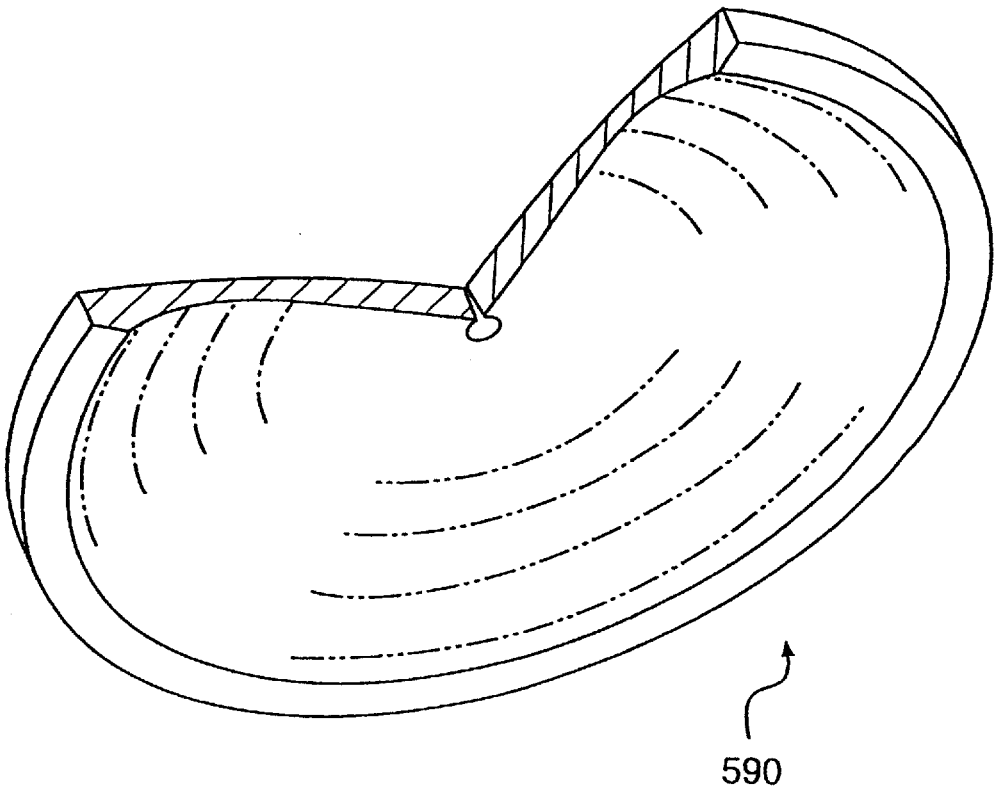
Figure 15:
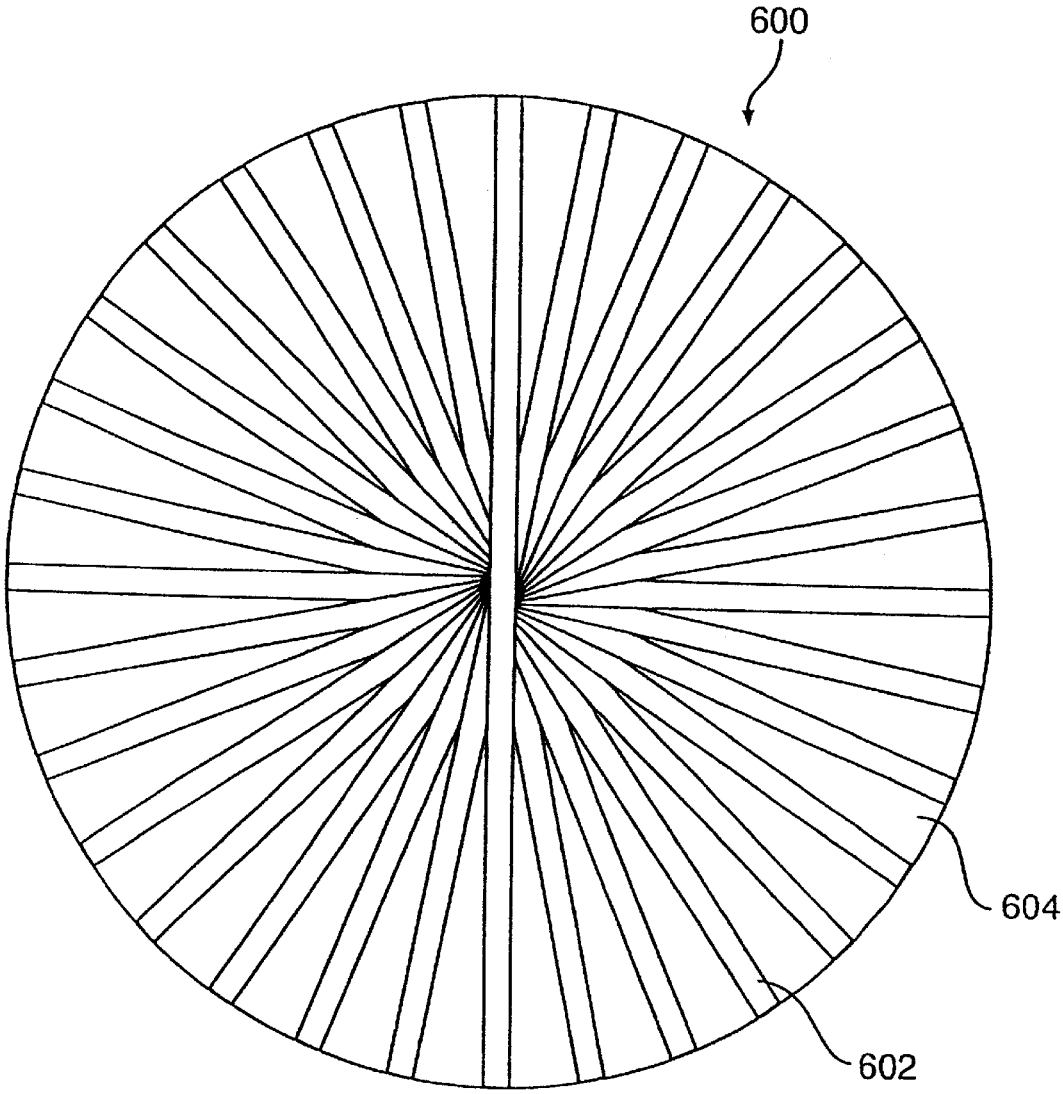
Figure 16:
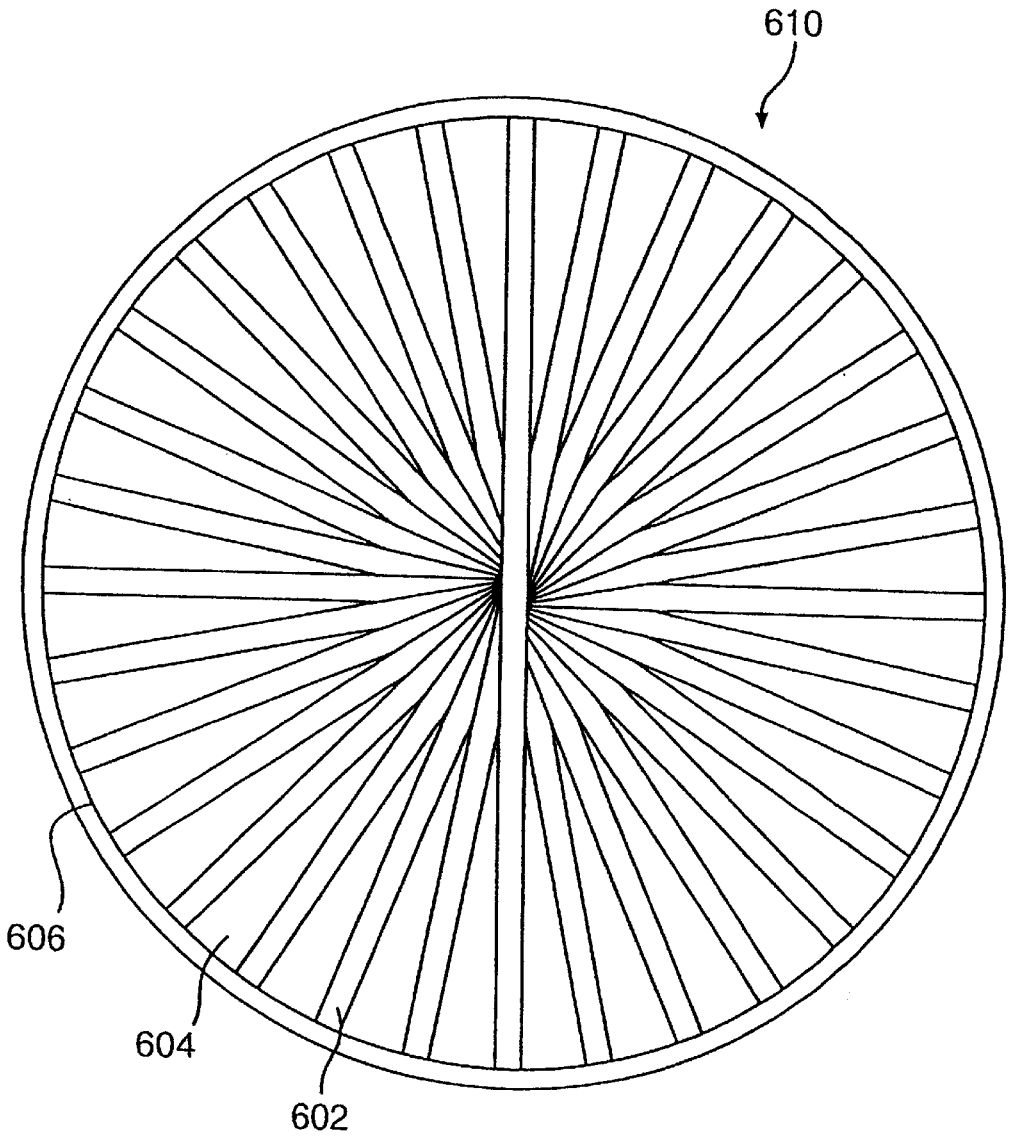

FIGS. 13 and 14 show farther variations of flexible plate 500 shown in FIG. 4. While flexible plate 500 has a generally uniform thickness at any given radius, flexible plate 585 shown in FIG. 13 decreases in thickness from the center of the member toward its periphery. Flexible member 590 shown in FIG. 14, on the other hand, is thicker near the center and at the periphery, but thinner therebetween.

Figure 17:
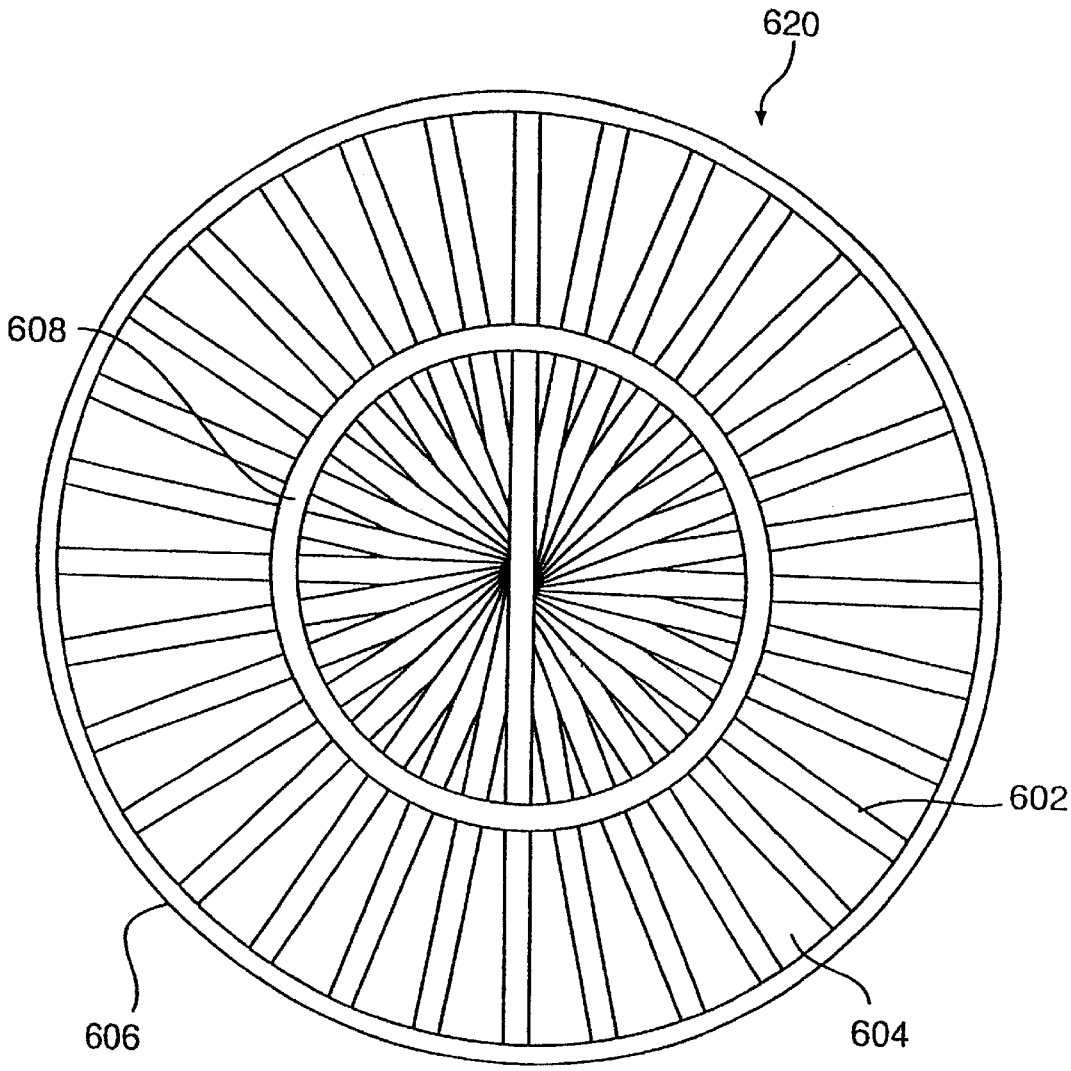
Figure 17A:
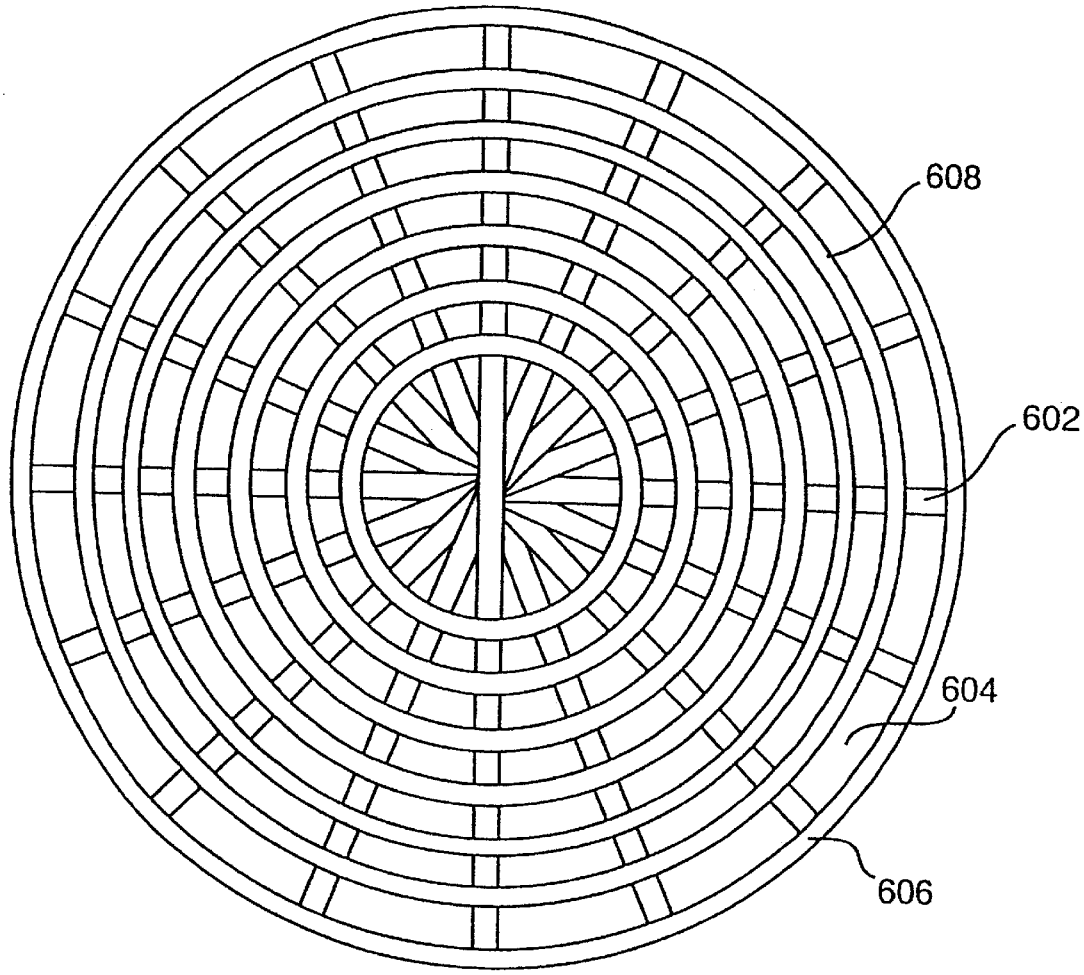

FIGS. 15–17A disclose flexible members composed of carbon ribbons set in a resin binder. Alternatively, they may be fiberglass ribbons or a combination of carbon and fiberglass ribbons. Ribbons made of other types of fiber may also be used. Flexible member 600 includes radially or diametrically projecting ribbons 602, either emanating from the center of flexible member toward its periphery or, preferably, passing through the center from a point on the periphery to a diametrically opposite point on the periphery. These ribbons 602 are fixed in position by a resin binder 604 known in the art. Flexible member 610 shown in FIG. 16 also includes carbon ribbons 602 set in a resin binder 604, but further includes a rim 606 comprised of ribbon preset in the resin binder and defining the periphery of flexible member 610. Flexible member 620 shown in FIG. 17 is identical to flexible member 610 shown in FIG. 16 except that it further includes a circular ribbon 608 disposed in resin binder 604 and circumscribing the center of flexible member 620. The flexible member shown in FIG. 17A is identical to the flexible member 610 shown in FIG. 17 except that it has fewer spokes and further includes a plurality of circular ribbons 608 spaced radially from the center of the member and disposed in the resin binder 604. Flexible members 600, 610, and 620 may be convex in shape so that the center of the flexible member is raised relative to its outer perimeter, when placed in the shoe. They may also have a U-shaped cushioning member placed on or secured to their top surface like that shown in FIG. 18.

Figure 18:
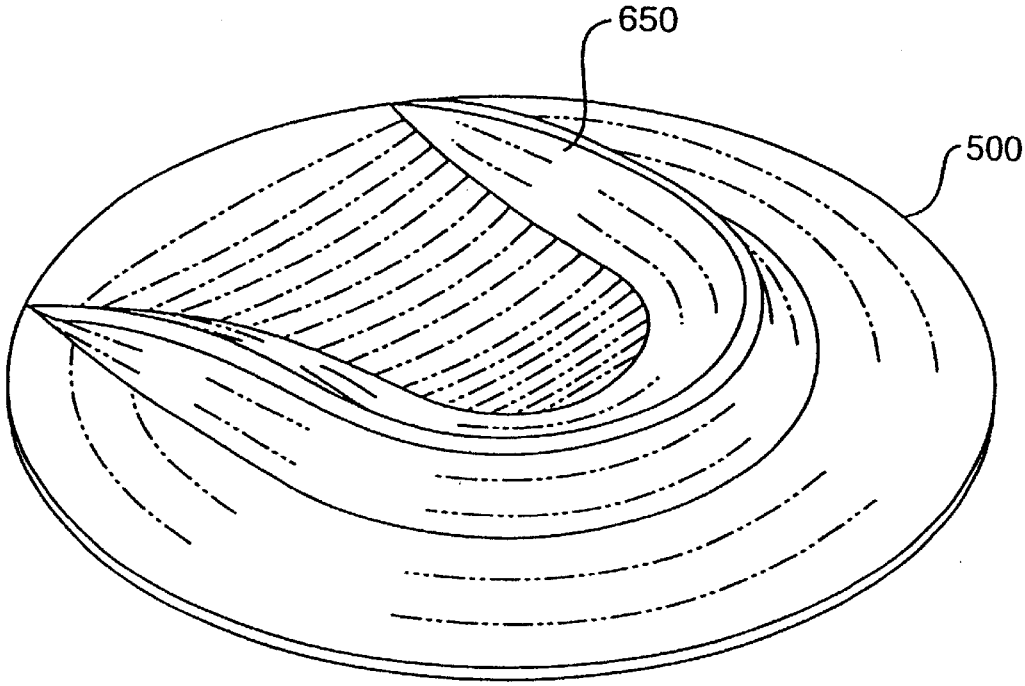

Since it is contemplated that the flexible member will be composed of graphite or other stiff, but flexible, material, it is preferable to cushion the impact of the user's heel against the flexible member during use. As shown in FIG. 18, a substantially U-shaped cushioning member 650 is disposed on the top surface of flexible member 500 to cushion the heel upon impact. The U-shaped cushioning member is shaped to generally conform to the shape of the user's heel. Thus, the open end of the U-shape is oriented toward the front of the shoe. Cushioning member 650 may be composed of polyurethane or EVA or may be an air-filled or gel-filled member. Cushioning member 650 can be affixed to flexible member 500 by gluing, or may be made integral with flexible in member 500 in an injection molding process. If injection molded, cushioning member 650 would be made of the same material as flexible member 500. To decrease the stiffness of cushioning member 650 in this instance, small holes (not shown) may be drilled in cushioning member 650 to weaken it and thereby allow it to depress more readily upon impact and more uniformly with flexible member 500.

The cushioning member 650 described above can be incorporated into a shoe having any of the various flexible regions disclosed in this application and drawings, as well as other shoes falling within the scope of the claims.

If cushioning member 650 is used, the shoe sock liner, which generally provides cushioning, may be thinner in the heel area or may terminate at the forward edge of cushioning member 650. If cushioning member 650 is not used, the sock liner may extend to the rear of the shoe and may be shaped to conform to the user's heel on its top surface and the flexible member on its bottom surface. Its bottom surface may also compensate for gaps formed by the flexible member. For example, the sock liner may have a concave bottom surface in the heel area to correspond to those flexible members having convex upper surfaces.

In each of the above described embodiments, the flexible member is illustrated as a separate component of the shoe which can be removed from the shoe and replaced by a similar or different flexible member, as desired. In each of the embodiments the central portion of the flexible member is raised relative to its outer perimeter so that when placed in the shoe, the interior portion in its normal state does not touch the rear sole support and/or rear sole. As a result, the interior of the flexible member will flex in response to the user's stride without first, if ever, contacting the rear sole support and/or rear sole. Such flexible member, therefore, can be used with rear soles that have a flat upper surface, as well as those that have a concave upper surface. The relative shape and positioning of the flexible member and the adjacent rear sole support or rear sole can be designed to provide the optimum flex, stiffness, and spring characteristics. However, each of the above-described flexible members may be made integral with the rear sole support, which not only decreases the number of loose parts and increases the efficiency of the manufacturing process, but also further limits the lateral displacement of the periphery of the flexible member upon deflection, potentially creating more spring in the center and/or permitting the use of thinner and/or lighter weight material.

Figure 19:
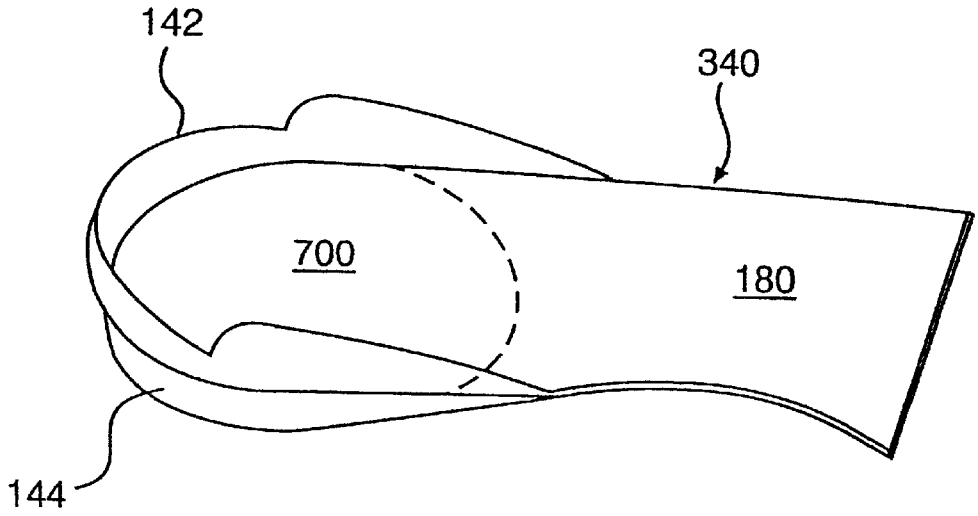
FIG. 19 is an isometric view of another embodiment of a rear sole support for use in the shoe of the present invention.

As shown in FIG. 19, rear sole support 340 is identical in structure to rear sole support 140 shown in FIG. 2 except that rear sole support 340 has a flexible region 700 that serves the same purpose and function as any of the above-described flexible members. In fact, any of the above-described flexible members may be used as flexible region 700 so long as they can be made integral with rear sole support 340. In this example, flexible region 700 is convex in shape and thus similar to flexible member 500 shown in FIG. 4. Cushioning member 650 or a modified sock liner as described above may also be used.

The flexible region may be incorporated into other rear sole support embodiments as well. As an alternative to using arch extension 180, rear sole support 440 shown in FIGS. 20–22 includes a thickened tongue 447 that extends toward the ball of the foot. Thickened tongue 447 provides additional gluing surface for attaching the rear sole support to forward sole 160 and additional stiffness to the heel portion of the shoe and the arch area, thus mining the chances of separation of the forward sole from the rear sole support, and at the same time minimizing the tendency of the shoe to curl at the juncture of the hard rear sole support with the soft forward sole. Similar to rear sole support 240, rear sole support 440 includes a heel counter 442 and a side wall 444. Rear sole support 440 also includes a rim 448 and anchors 452 to receive and retain a rear sole with a mating groove, such as rear sole 250. Forward sole 260 is longer in this embodiment to extend back to the edge where it would abut the rear sole. Flexible region 710 is identical to flexible region 700 in FIG. 19.

Figure 20:
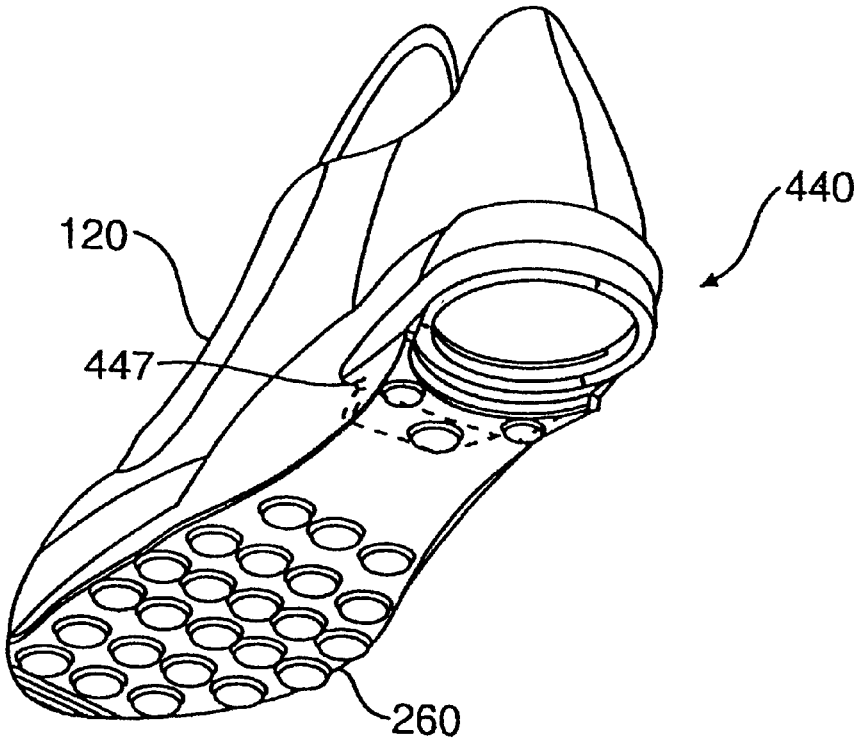
FIG. 20 is an isometric view of another embodiment of the shoe of the present invention.
Figure 21:
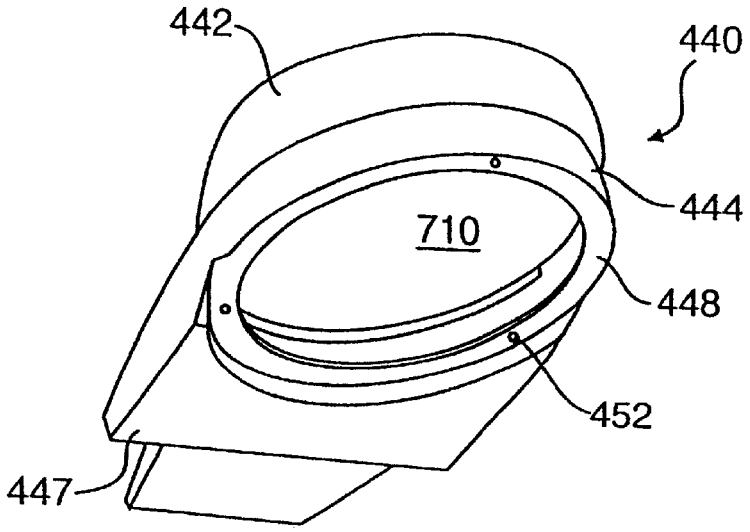
FIGS. 21 and 22 are isometric views of a rear sole support for the shoe of FIG. 20.
Figure 22:
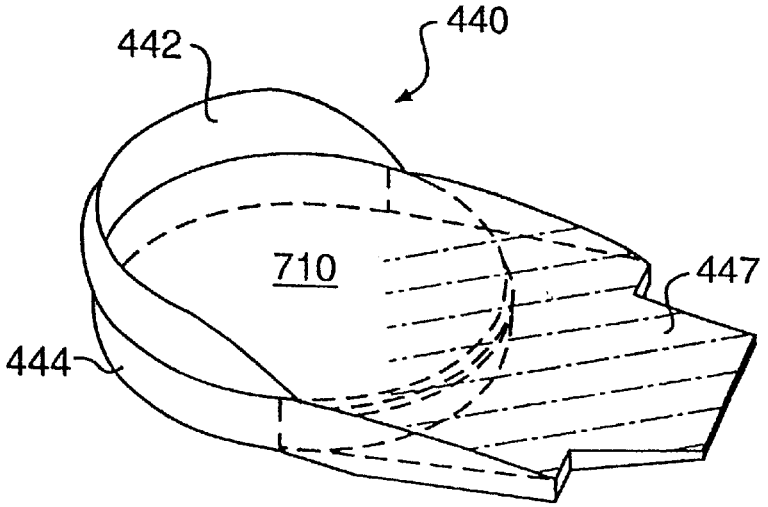
Figure 23:
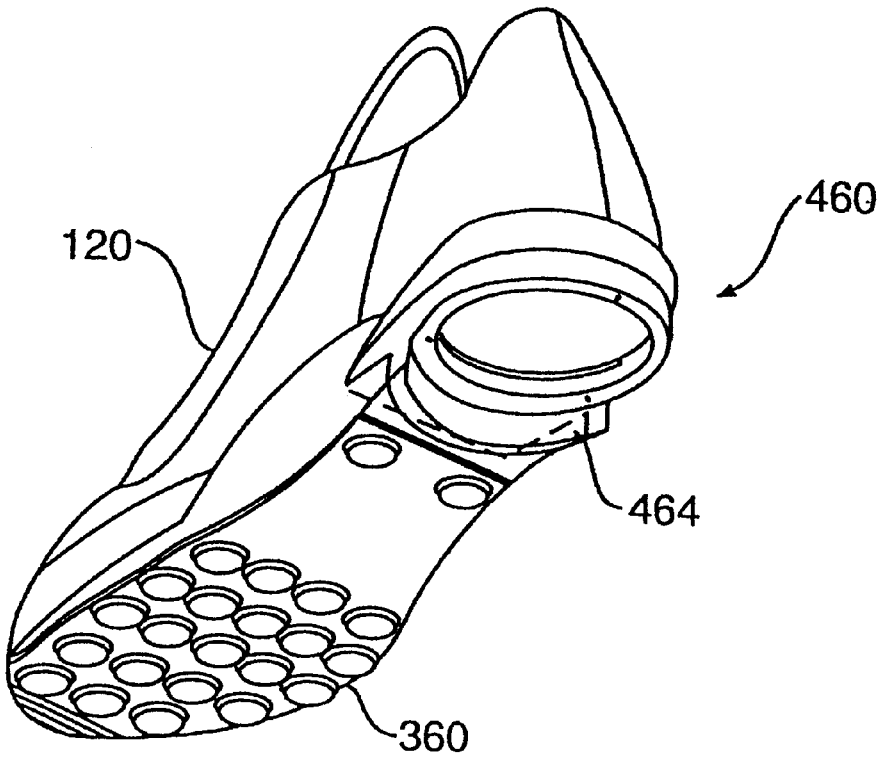
FIG. 23 is an isometric view of another embodiment of the shoe of the present invention.
Figure 24:
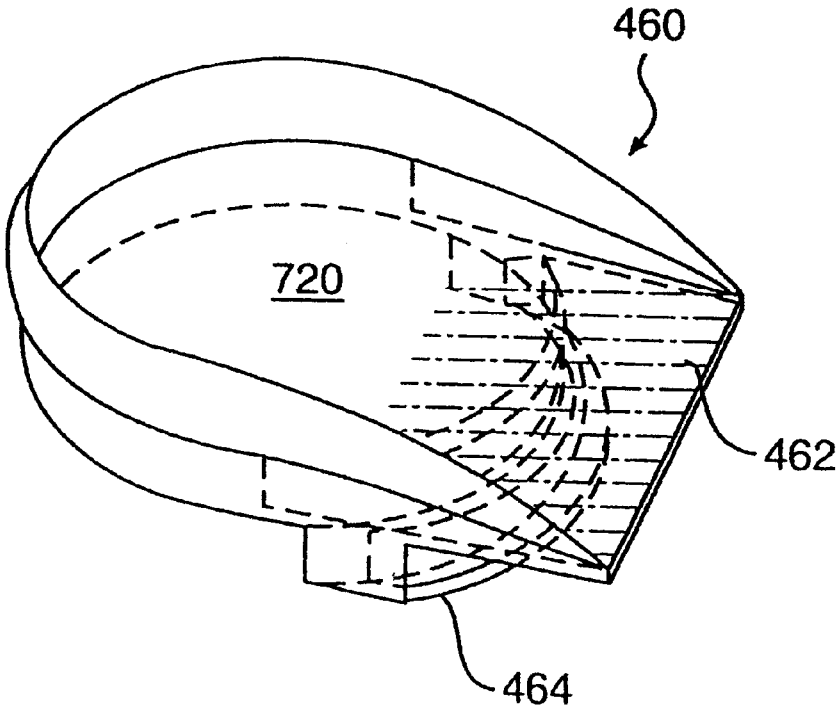
FIG. 24 is an isometric view of a rear sole support for the shoe of FIG. 23.

In another embodiment, rear sole support 460, as shown in FIGS. 23 and 24, includes a tongue 462 that is tinner and slightly smaller than tongue 447 shown in FIGS. 20–22. However, rear sole support 460 includes a curved wall 464 that has a pocket formed on its forward side for receiving a rating rear edge of forward sole 360 adjacent the rear sole support. Curved wall 464 provides a firm, smoothly contoured transition from hard-to-align resilient materials of the forward and rear soles and thereby minimizes gapping. It also provides a desirable brace or bumper for the lower portion of the rear sole when the user is running. Flexible region 720 is identical to flexible regions 700 and 710.

Figure 25:
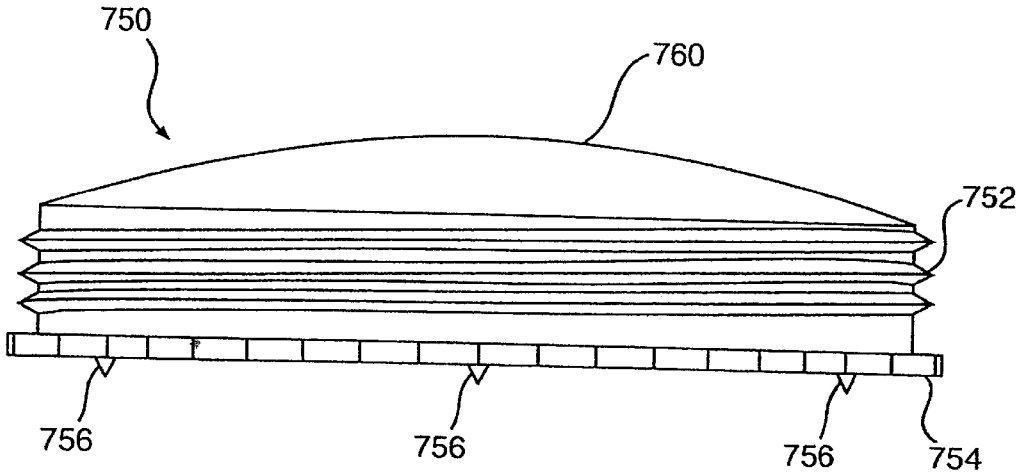
FIG. 25 is a side elevation view of a securing member for use in the shoe of the present invention.
Figure 26:
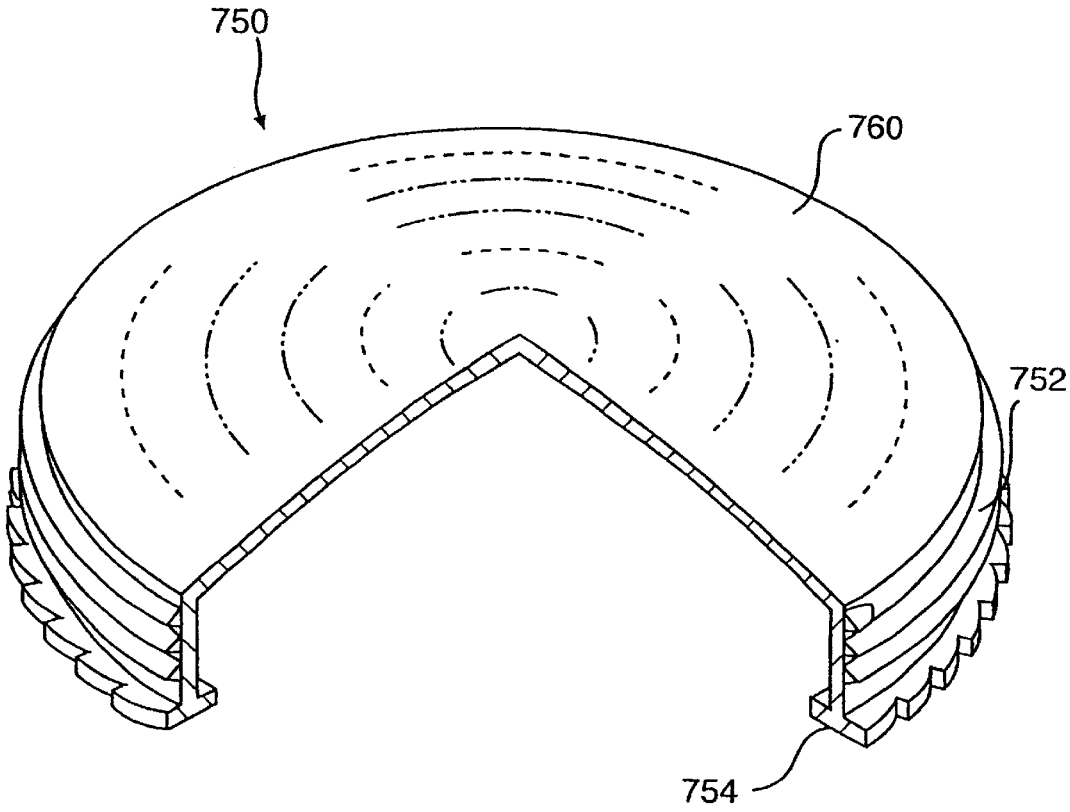
FIG. 26 is a partial cut-away isometric view of the securing member of FIG. 25.
Figure 28:
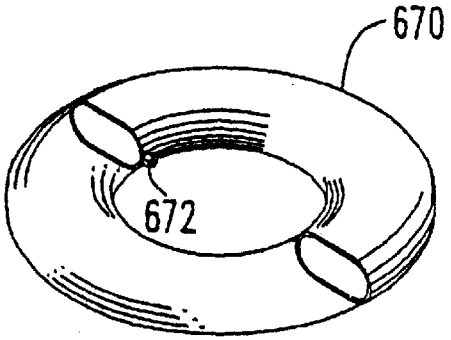
FIGS. 27–29 are views of a rear sole for use in the shoe of the present invention.
Figure 29:
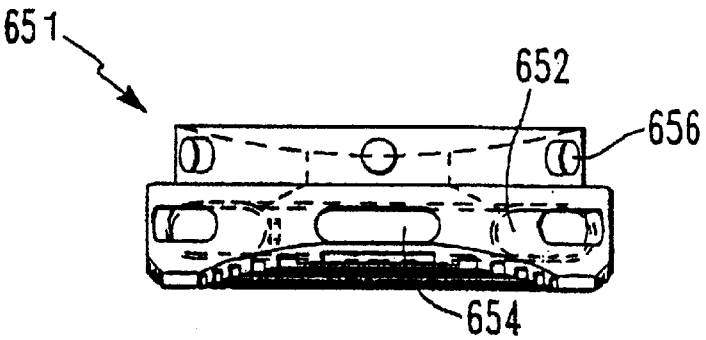
Figure 27:
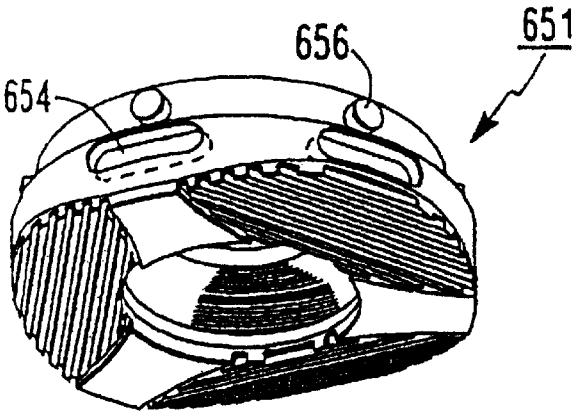

As shown in FIGS. 25 and 26, the flexible member may also be integrated with the securing member. Securing member 750 is similar in structure and function as securing member 400 in that it includes a wall 752 with a threaded outer surface, an inwardly and outwardly extending rim 754, and anchors 756. Securing member 750 also includes a convex flexible region 760 integral with wall 752. Flexible region 760, like flexible regions 700 and 710, may incorporate any of the configurations shown in FIGS. 4–18.

Securing member 750 is simply substituted for securing member 400 and flexible member 200 shown in FIG. 3 to attach rear sole 250 to rear sole support 240. However, since sec g member 750 does not include mating ends 416, 418, rear sole 250 is press-fitted into securing member 70 until rear sole groove 2154 mates with securing member rim 754. This may have the effect of making the center of the flexible member more springy. It may also allow the flexible member to be made of thinner and/or lighter weight material.

It will be apparent to those skilled in the art that various modifications and variations can be made in the system of the present invention without departing from the scope or spirit of the invention. Thus, it is intended that the present invention cover the modifications and variations of this invention provided they come within the scope of the claims and their equivalents.

What is claimed is:

1. A shoe comprising:

an upper having a heel region;

a rear sole having a rearward portion and an opposite forward portion connected below the heel region, the rear sole having a bottom surface at least a portion of which is ground engaging, the bottom surface including at least one substantially planar portion and at least three portions non-planar with the at least one substantially planar portion, the non-planar portions being positioned proximate the perimeter of the rear sole and separated from each other by other portions of the bottom surface, each of the non-planar portions being inclined upwardly from another portion of the bottom surface in a direction toward the perimeter of the rear sole, one of the at least three non-planar portions being proximate the rearward portion of the rear sole, and at least two of the at least three non-planar portions being proximate the forward portion of the rear sole and being oriented so that at least one edge of one of the at least two non-planar portions proximate the forward portion of the rear sole is proximate a medial side of the rear sole and at least one edge of the other of the at least two non-planar portions proximate the forward portion of the rear sole is proximate a lateral side of the rear sole;

a flexible plate having upper and lower surfaces and supported between at least a portion of the rear sole and at least a portion of the heel region of the upper, peripheral portions of the plate being restrained from movement relative to an interior portion of the plate in a direction substantially perpendicular to a major axis of the shoe so that the interior portion of the plate is capable of being deflected relative to the peripheral portions in a direction substantially perpendicular to the major axis of the shoe, at least a portion of the upper surface of the plate being convex, at least a portion of the lower surface of the plate being concave, the interior portion of the plate being positioned over a void; and an opening in the bottom surface of the rear sole located beneath the interior portion of the plate, the opening being in communication with the void to expose the interior portion of the plate from outside of the shoe.

2. The shoe of claim 1, wherein each of the non-planar portions has a maximum linear dimension less than the greatest width of the bottom surface along a line perpendicular to a major axis of the shoe.

3. The shoe of claim 1, wherein the bottom surface includes an outsole material that is ground engaging, the rear sole including midsole material above the outsole material, at least a portion of the midsole material above the non-planar portions being thinner than the midsole material above the at least one substantially planar portion of the bottom surface of the rear sole.

4. The shoe of claim 1, further comprising at least one wall proximate at least a portion of the peripheral portions of the plate and extending in at least one of an upwardly direction and a downwardly direction from the plate, the at least one wall being integral with the plate.

5. The shoe of claim 1, wherein the upper has an arch region, and further comprising an arch bridge integral with the plate, the arch bridge extending from a position proximate a forward portion of the plate, forward beneath at least a portion of the arch region of the upper.

6. The shoe of claim 5, wherein the arch bridge has a bottom surface that is at least in part visible from outside of the shoe.

7. The shoe of claim 1, wherein the upper surface has at least two convex portions, at least a portion of the upper surface being concave, the concave portion of the upper surface being located between the two convex portions of the upper surface.

8. The shoe of claim 1, further comprising at least one sidewall above at least a portion of the bottom surface of the rear sole, the at least one sidewall having at least one hole therethrough located on at least one of a lateral side, a medial side, and a rear of the shoe.

9. The shoe of claim 1, wherein at least a substantial portion of the peripheral portions of the flexible plate is restrained from movement relative to the interior portion of the flexible plate.

10. The shoe of claim 1, wherein the peripheral portions of the flexible plate being restrained from movement relative to the interior portion are at a point along a medial side and at a point along a lateral side of the shoe.

11. The shoe of claim 1, wherein a forward facing portion and a rearward facing portion of the peripheral portions of the flexible plate are restrained from movement relative to the interior portion.

12. The shoe of claim 1, wherein the peripheral portions of the flexible plate are restrained from movement relative to the interior portion at at least two spaced apart points along a medial side of the shoe and at at least two spaced apart points along a lateral side of the shoe, the interior portion of the plate being located above a point between the at least two points along the medial side of the shoe and the at least two points along the lateral side of the shoe and beneath the approximate center of the user's heel.

13. The shoe of claim 12, wherein upon the deflection of the interior portion of the plate, the at least two points along the medial side of the shoe and the at least two points along the lateral side of the shoe are displaceable in a direction substantially parallel to the ground.

14. The shoe of claim 1, wherein the peripheral portions of the flexible plate are restrained from movement relative to the interior portion both along at least a portion of a medial side and at least a portion of a lateral side of the shoe and on at least a portion of a forward facing portion and at least a portion of a rearward facing portion of the peripheral portions of the flexible plate.

15. The shoe of claim 1, wherein at least one of the peripheral portions of the plate being restrained from movement is along the upper surface of the plate and at least one of the peripheral portions of the plate being restrained from movement is along the lower surface of the plate.

16. The shoe of claim 15, wherein the peripheral portions are both toward the front of the shoe.

17. The shoe of claim 15, wherein the peripheral portions are both toward the back of the shoe.

18. The shoe of claim 15, wherein the peripheral portions are both on the lateral side of the shoe.

19. The shoe of claim 15, wherein the peripheral portions are both on the medial side of the shoe.

20. The shoe of claim 15, wherein the peripheral portions of the upper and lower surfaces are proximate one another.

21. The shoe of claim 20, where the capable of being deflected interior portion is located between the portions of the upper and lower surfaces and a point beneath a central portion of the heel region of the upper.

22. A shoe comprising:

an upper having a heel region and an arch region;

a rear sole having a bottom surface, the rear sole being secured below the heel region of the upper;

a flexible plate having upper and lower surfaces and supported between at least a portion of the rear sole and at least a portion of the heel region of the upper, peripheral portions of the plate being restrained from movement relative to an interior portion of the plate in a direction substantially perpendicular to a major axis of the shoe so that the interior portion of the plate is capable of being deflected relative to the peripheral portions in a direction substantially perpendicular to the major axis of the shoe, at least a portion of the upper surface of the plate being convex, at least a portion of the lower surface of the plate being concave, the interior portion of the plate being positioned over a void;

an opening in the bottom surface of the rear sole located beneath the interior portion of the plate, the opening being in communication with the void to expose the interior portion of the plate from outside of the shoe;

an arch bridge integral with the plate, the arch bridge extending from a position proximate a forward portion of the plate, forward beneath at least a portion of the arch region of the upper; and at least one wall proximate at least a portion of the peripheral portions of the plate and extending in at least one of an upwardly direction and a downwardly direction from the plate, the at least one wall being integral with the plate.

23. The shoe of claim 22, wherein the at least one wall extends in an upwardly direction.

24. The shoe of claim 23, wherein the upwardly extending wall is connected to at least a portion of the heel region of the upper.

25. The shoe of claim 23, wherein at least a portion of the upwardly extending wall is visible from outside of the shoe.

26. The shoe of claim 25, wherein at least a portion of the upwardly extending wall is visible from a medial side of the shoe, from a lateral side of the shoe, and from a rear of the shoe.

27. The shoe of claim 23, wherein the at least one wall includes a wall extending in a downwardly direction.

28. The shoe of claim 27, wherein the downwardly extending wall contacts at least a portion of the rear sole.

29. The shoe of claim 27, wherein at least a portion of the downwardly extending wall is visible from outside of the shoe.

30. The shoe of claim 29, wherein at least a portion of the downwardly extending wall is visible from a medial side of the shoe, from a lateral side of the shoe, and from a rear of the shoe.

31. The shoe of claim 22, wherein the at least one wall extends in a downwardly direction.

32. The shoe of claim 31, wherein the downwardly extending wall contacts at least a portion of the rear sole.

33. The shoe of claim 31, wherein at least a portion of the downwardly extending wall is visible from outside of the shoe.

34. The shoe of claim 22, wherein the arch bridge is integral with an upwardly extending wall on at least one of a lateral side and a medial side of the shoe.

35. The shoe of claim 34, wherein the upwardly extending wall is at least in part visible from outside of the shoe.

36. The shoe of claim 22, wherein the arch bridge has a bottom surface that is at least in substantial part visible from outside of the shoe.

37. The shoe of claim 36, wherein the bottom surface of the arch bridge is visible on a line perpendicular to a major axis of the shoe across a width of the arch bridge.

38. The shoe of claim 22, wherein the arch bridge is integral with a downwardly extending wall.

39. The shoe of claim 38, wherein at least a portion of the downwardly extending wall is visible from outside of the shoe.

40. The shoe of claim 38, wherein the downwardly extending wall contacts at least a portion of the rear sole.

41. The shoe of claim 38, wherein the downwardly extending wall is integral with a rearward portion of the arch bridge.

42. The shoe of claim 38, wherein the downwardly extending wall is arcuate.

43. The shoe of claim 38, wherein the downwardly extending wall is at least in pad acurate.

44. The shoe of claim 38, wherein the downwardly extending wall is curved.

45. The shoe of claim 38, wherein the downwardly extending wall is at least in part curved.

46. The shoe of claim 22, wherein the rear sole has a rearward portion and an opposite forward portion connected below the heel region, the rear sole having a bottom surface at least a portion of which is ground engaging, the bottom surface including at least one substantially planar portion and at least two portions non-planar with the at least one substantially planar portion, the non- planar portions being positioned proximate the perimeter of the rear sole and separated from each other by other portions of the bottom surface, each of the non-planar portions being inclined upwardly from another portion of the bottom surface in a direction toward the perimeter of the rear sole, one of the at least two non-planar portions being proximate the rearward portion of the rear sole, and the other of the at least two non-planar portions being proximate the forward portion of the rear sole.

47. The shoe of claim 22, wherein the upper surface has at least two convex portions, at least a portion of the upper surface being concave, the concave portion of the upper surface being located between the two convex portions of the upper surface.

48. The shoe of claim 22, further comprising at least one sidewall above at least a portion of the bottom surface of the rear sole, the at least one sidewall having at least one hole therethrough located on at least one of a lateral side, a medial side, and a rear of the shoe.

49. The shoe of claim 22, wherein at least a substantial portion of the peripheral portions of the flexible plate is restrained from movement relative to the interior portion of the flexible plate.

50. The shoe of claim 22, wherein the peripheral portions of the flexible plate being restrained from movement relative to the interior portion are at a point along a medial side and at a point along a lateral side of the shoe.

51. The shoe of claim 22, wherein a forward facing portion and a rearward facing portion of the peripheral portions of the flexible plate are restrained from movement relative to the interior portion.

52. The shoe of claim 22, wherein the peripheral portions of the flexible plate are restrained from movement relative to the interior portion at at least two spaced apart points along a medial side of the shoe and at at least two spaced apart points along a lateral side of the shoe, the interior portion of the plate being located above a point between the at least two points along the medial side of the shoe and the at least two points along the lateral side of the shoe and beneath the approximate center of the users heel.

53. The shoe of claim 52, wherein upon the deflection of the interior portion of the plate, the at least two points along the medial side of the shoe and the at least two points along the lateral side of the shoe are displaceable in a direction substantially parallel to the ground.

54. The shoe of claim 22, wherein the peripheral portions of the flexible plate are restrained from movement relative to the interior portion both along at least a portion of a medial side and at least a portion of a lateral side of the shoe and on at least a portion of a forward facing portion and at least a portion of a rearward facing portion of the peripheral portions of the flexible plate.

55. The shoe of claim 22, wherein at least one of the peripheral portions of the plate being restrained from movement is along the upper surface of the plate and at least one of the peripheral portions of the plate being restrained from movement is along the lower surface of the plate.

56. The shoe of claim 55, wherein the peripheral portions are both toward the front of the shoe.

57. The shoe of claim 55, wherein the peripheral portions are both toward the back of the shoe.

58. The shoe of claim 55, wherein the peripheral portions are both on the lateral side of the shoe.

59. The shoe of claim 55, wherein the peripheral portions are both on the medial side of the shoe.

60. The shoe of claim 55, wherein the peripheral portions of the upper and lower surfaces are proximate one another.

61. The shoe of claim 60, wherein the capable of being deflected interior portion is located between the peripheral portions of the upper and lower surfaces and a point beneath a central portion of the heel region of the upper.

62. A shoe comprising:

an upper having a heel region;

a rear sole having a bottom surface, the rear sole being secured below the heel region of the upper;

a flexible plate having upper and lower surfaces and supported between at least a portion of the rear sole and at least a portion of the heel region of the upper, peripheral portions of the plate being restrained from movement relative to an interior portion of the plate in a direction substantially perpendicular to a major axis of the shoe so that the interior portion of the plate is capable of being deflected relative to the peripheral portions in a direction substantially perpendicular to the major axis of the shoe, at least a portion of the upper surface of the plate being convex, at least a portion of the lower surface of the plate being concave, the interior portion of the plate being positioned over a void;

an opening in the bottom surface of the rear sole located beneath the interior portion of the plate, the opening being in communication with the void to expose the interior portion of the plate from outside of the shoe; and at least one sidewall above at least a portion of the bottom surface of the rear sole, the at least one sidewall having at least one hole therethrough located on at least one of a lateral side, a medial side, and a rear of the shoe.

63. The shoe of claim 62, wherein the at least one hole includes at least two holes, at least one of the at least two holes being on the medial side of the shoe and at least one of the at least two holes being on the lateral side of the shoe.

64. The shoe of claim 63, wherein the plate is at least in pad visible through both of the at least two holes.

65. The shoe of claim 62, wherein the plate is at least in part visible through the at least one hole.

66. The shoe of claim 62, wherein the at least one sidewall has an interior surface, the void being defined at least in part by the interior surface of the at least one sidewall.

67. The shoe of claim 66, wherein the void is at least in part visible through the at least one hole.

68. The shoe of claim 67, wherein at least one hole includes at least two holes, at least one of the at least two holes being on the medial side of the shoe and at least one of the at least two holes being on the lateral side of the shoe, the void being at least in part visible through both of the at least two holes.

69. The shoe of claim 66, wherein the interior surface of the at least one sidewall is visible through the opening in the bottom surface of the rear sole.

70. The shoe of claim 66, wherein at least a portion of the interior surface of the at least one sidewall is visible through the at least one hole in the at least one sidewall.

71. The shoe of claim 66, wherein the at least one hole in the at least one sidewall is on the lateral side of the shoe, the interior surface of the at least one sidewall on the medial side of the shoe being visible through the at least one hole.

72. The shoe of claim 62, wherein the at least one sidewall includes midsole material.

73. The shoe of claim 62, wherein the at least one sidewall includes outsole material.

74. The shoe of claim 62, wherein the at least one sidewall includes both midsole material and outsole material.

75. The shoe of claim 62, further comprising at least one wall proximate at least a portion of the peripheral portions of the plate and extending in at least one of an upwardly direction and a downwardly direction from the plate, the at least one wall being integral with the plate.

76. The shoe of claim 62, wherein the upper has an arch region, and further comprising an arch bridge integral with the plate, the arch bridge extending from a position proximate a forward portion of the plate, forward beneath at least a portion of the arch region of the upper.

77. The shoe of claim 76, wherein the arch bridge has a bottom surface that is at least in part visible from outside of the shoe.

78. The shoe of claim 62, wherein the rear sole has a rearward portion and an opposite forward portion connected below the heel region, the rear sole having a bottom surface at least a portion of which is ground engaging, the bottom surface including at least one substantially planar portion and at least two portions non-planar with the at least one substantially planar portion, the non- planar portions being positioned proximate the perimeter of the rear sole and separated from each other by other portions of the bottom surface, each of the non-planar portions being inclined upwardly from another portion of the bottom surface in a direction toward the perimeter of the rear sole, one of the at least two non-planar portions being proximate the rearward portion of the rear sole, and the other of the at least two non-planar portions being proximate the forward portion of the rear sole.

79. The shoe of claim 62, wherein the upper surface has at least two convex portions, at least a portion of the upper surface being concave, the concave portion of the upper surface being located between the two convex portions of the upper surface.

80. The shoe of claim 62, wherein at least a substantial portion of the peripheral portions of the flexible plate is restrained from movement relative to the interior portion of the flexible plate.

81. The shoe of claim 62, wherein the peripheral portions of the flexible plate being restrained from movement relative to the interior portion are at a point along a medial side and at a point along a lateral side of the shoe.

82. The shoe of claim 62, wherein a forward facing portion and a rearward facing portion of the peripheral portions of the flexible plate are restrained from movement relative to the interior portion.

83. The shoe of claim 62, wherein the peripheral portions of the flexible plate are restrained from movement relative to the interior portion at at least two spaced apart points along a medial side of the shoe and at at least two spaced apart points along a lateral side of the shoe, the interior portion of the plate being located above a point between the at least two points along the medial side of the shoe and the at least two points along the lateral side of the shoe and beneath the approximate center of the user's heel.

84. The shoe of claim 83, wherein upon the deflection of the interior portion of the plate, the at least two points along the medial side of the shoe and the at least two points along the lateral side of the shoe are displaceable in a direction substantially parallel to the ground.

85. The shoe of claim 62, wherein the peripheral portions of the flexible plate are restrained from movement relative to the interior portion both along at least a portion of a medial side and at least a portion of a lateral side of the shoe and on at least a portion of a forward facing portion and at least a portion of a rearward facing portion of the peripheral portions of the flexible plate.

86. The shoe of claim 62, wherein at least one of the peripheral portions of the plate being restrained from movement is along the upper surface of the plate and at least one of the peripheral portions of the plate being restrained from movement is along the lower surface of the plate.

87. The shoe of claim 86, wherein the peripheral portions are both toward the front of the shoe.

88. The shoe of claim 86, wherein the peripheral portions are both toward the back of the shoe.

89. The shoe of claim 86, wherein the peripheral portions are both on the lateral side of the shoe.

90. The shoe of claim 86, wherein the peripheral portions are both on the medial side of the shoe.

91. The shoe of claim 86, wherein the peripheral portions of the upper and lower surfaces are proximate one another.

92. The shoe of claim 91, wherein the capable of being deflected interior portion is located between the peripheral portions of the upper and lower surfaces and a point beneath a central portion of the heel region of the upper.

93. A shoe comprising:

an upper having a heel region;

a rear sole secured below the heel region of the upper; and a flexible plate having upper and lower surfaces and positioned between at least a portion of the rear sole and at least a portion of the heel region of the upper, peripheral portions of the plate being restrained from movement relative to an interior portion of the plate in a direction substantially perpendicular to a major axis of the shoe so that the interior portion of the plate is capable of being deflected relative to the peripheral portions in a direction substantially perpendicular to the major axis of the shoe, the upper surface having at least one concave portion, and the lower surface being at least in part visible from outside of the shoe.

94. The shoe of claim 93, wherein the lower surface is at least in part visible through an opening in the rear sole.

95. The shoe of claim 93, wherein the upper surface has at least one convex portion, the at least one convex portion being adjacent the at least one concave portion of the upper surface.

96. The shoe of claim 95, wherein the upper surface has at least two convex portions, the concave portion of the upper surface being located between the convex portions of the upper surface.

97. The shoe of claim 96, further comprising at least one wall proximate at least a portion of the peripheral portions of the plate and extending in at least one of an upwardly direction and a downwardly direction from the plate ,the at least one wall being integral with the plate.

98. The shoe of claim 96, wherein the upper has an arch region, and further comprising an arch bridge integral with the plate, the arch bridge extending from a position proximate a forward portion of the plate, forward beneath at least a portion of the arch region of the upper, the arch bridge having a bottom surface that is at least in part visible from outside of the shoe.

99. The shoe of claim 96, wherein the rear sole has a rearward portion and an opposite forward portion connected below the heel region, the rear sole having a bottom surface at least a portion of which is ground engaging, the bottom surface including at least one substantially planar portion and at least two portions non-planar with the at least one substantially planar portion, the non- planar portions being positioned proximate the perimeter of the rear sole and separated from each other by other portions of the bottom surface, each of the non-planar portions being inclined upwardly from another portion of the bottom surface in a direction toward the perimeter of the rear sole, one of the at least two non-planar portions being proximate the rearward portion of the rear sole. and the other of the at least two non-planar portions being proximate the forward portion of the rear sole.

100. The shoe of claim 93, further comprising at least one wall extending in at least one of an upwardly direction and a downwardly direction, the at least one wall being integral with at least a portion of the peripheral portions of the plate.

101. The shoe of claim 93, wherein the upper has an arch region, and further comprising an arch bridge integral with the plate, the arch bridge extending from a position proximate a forward portion of the plate, forward beneath at least a portion of the arch region of the upper, the arch bridge further having a bottom surface that is at least in part visible from outside of the shoe.

102. The shoe of claim 93, wherein the rear sole has a rearward portion and an opposite forward portion connected below the heel region, the rear sole having a bottom surface at least a portion of which is ground engaging, the bottom surface including at least one substantially planar portion and at least two portions non-planar with the at least one substantially planar portion, the non- planar portions being positioned proximate the perimeter of the rear sole and separated from each other by other portions of the bottom surface, each of the non-planar portions being inclined upwardly from another portion of the bottom surface in a direction toward the perimeter of the rear sole, one of the at least two non-planar portions being proximate the rearward portion of the rear sole, and the other of the at least two non-planar portions being proximate the forward portion of the rear sole.

103. The shoe of claim 93, further comprising at least one sidewall above at least a portion of the bottom surface of the rear sole, the at least one sidewall having at least one hole therethrough located on at least one of a lateral side, a medial side, and a rear of the shoe.

104. The shoe of claim 93, wherein at least a substantial portion of the peripheral portions of the flexible plate is restrained from movement relative to the interior portion of the flexible plate.

105. The shoe of claim 93, wherein the peripheral portions of the flexible plate being restrained from movement relative to the interior portion are at a point along a medial side and at a point along a lateral side of the shoe.

106. The shoe of claim 93, wherein a forward facing portion and a rearward facing portion of the peripheral portions of the flexible plate are restrained from movement relative to the interior portion.

107. The shoe of claim 93, wherein the peripheral portions of the flexible plate are restrained from movement relative to the interior portion at at least two spaced apart points along a medial side of the shoe and at at least two spaced apart points along a lateral side of the shoe, the interior portion of the plate being located above a point between the at least two points along the medial side of the shoe and the at least two points along the lateral side of the shoe and beneath the approximate center of the user's heel.

108. The shoe of claim 107, wherein upon the deflection of the interior portion of the plate, the at least two points along the medial side of the shoe and the at least two points along the lateral side of the shoe are displaceable in a direction substantially parallel to the ground.

109. The shoe of claim 93, wherein the peripheral portions of the flexible plate are restrained from movement relative to the interior portion both along at least a portion of a medial side and at least a portion of a lateral side of the shoe and on at least a portion of a forward facing portion and a rearward facing portion of the peripheral portions of the flexible plate.

110. The shoe of claim 93, wherein at least one of the peripheral portions of the plate being restrained from movement is along the upper surface of the plate and at least one of the peripheral portions of the plate being restrained from movement is along the lower surface of the plate.

111. The shoe of claim 110, wherein the peripheral portions are both toward the front of the shoe.

112. The shoe of claim 110, wherein the peripheral portions are both toward the back of the shoe.

113. The shoe of claim 110, wherein the peripheral portions are both on the lateral side of the shoe.

114. The shoe of claim 110, wherein the peripheral portions are both on the medial side of the shoe.

115. The shoe of claim 110, wherein the peripheral portions of the upper and lower surfaces are proximate one another.

116. The shoe of claim 115, wherein the capable of being deflected interior portion is located between the peripheral portions of the upper and lower surfaces and a point beneath a central portion of the heel region of the upper.

117. A shoe comprising:

an upper having a heel region;

a rear sole secured below the heel region of the upper;

a flexible plate having upper and lower surfaces and supported between at least a portion of the rear sole and at least a portion of the heel region of the upper, peripheral portions of the plate being restrained from movement relative to an interior portion of the plate in a direction substantially perpendicular to a major axis of the shoe so that the interior portion of the plate is capable of being deflected relative to the peripheral portions in a direction substantially perpendicular to the major axis of the shoe, at least one portion of a cross section of the plate perpendicular to a major axis of the shoe defining a curve in a direction generally from a medial side of the shoe to a lateral side of the shoe; and an opening in the bottom surface of the rear sole located beneath the interior portion of the plate that exposes the interior portion of the plate.

118. A shoe comprising:

an upper having a heel region;

a rear sole secured below the heel region of the upper;

a flexible plate having upper and lower surfaces and supported between at least a portion of the rear sole and at least a portion of the heel region of the upper, peripheral portions of the plate being restrained from movement relative to an interior portion of the plate in a direction substantially perpendicular to a major axis of the shoe so that the interior portion of the plate is capable of being deflected relative to the peripheral portions in a direction substantially perpendicular to the major axis of the shoe, at least one portion of a cross section of the plate parallel to the major axis of the shoe defining a curve in a direction generally from a front of the shoe to a back of the shoe; and an opening in the bottom surface of the rear sole located beneath the interior portion of the plate that exposes the interior portion of the plate.

119. The shoe of claim 118, wherein the upper surface has at least two convex portions, at least a portion of the upper surface being concave, the concave portion of the upper surface being located between the two convex portions of the upper surface.

120. The shoe of claim 118, wherein the peripheral portions of the flexible plate are restrained from movement relative to the interior portion at at least two spaced apart points along a medial side of the shoe and at at least two spaced apart points along a lateral side of the shoe, the interior portion of the plate being located above a point between the at least two points along the medial side of the shoe and the at least two points along the lateral side of the shoe and beneath the approximate center of the user's heel, the at least two points along the medial side of the shoe and the at least two points along the lateral side of the shoe being displaceable in a direction substantially parallel to the ground upon the deflection of the interior portion of the plate.

121. A shoe comprising:

an upper having a heel region;

a rear sole secured below the heel region of the upper;

a flexible plate having upper and lower surfaces and supported between at least a portion of the rear sole and at least a portion of the heel region of the upper, peripheral portions of the plate being restrained from movement relative to an interior portion of the plate in a direction substantially perpendicular to a major axis of the shoe so that the interior portion of the plate is capable of being deflected relative to the peripheral portions in a direction substantially perpendicular to the major axis of the shoe, at least one portion of a cross section of the plate perpendicular to a major axis of the shoe defining a curve in a direction generally from a medial side of the shoe to a lateral side of the shoe, at least one portion of a cross section of the plate parallel to the major axis of the shoe defining a curve in a direction generally from a front of the shoe to a back of the shoe; and an opening in the bottom surface of the rear sole located beneath the interior portion of the plate that exposes the interior portion of the plate.

122. A shoe comprising:

an upper having a heel region;

a rear sole secured below the heel region and having a rearward portion, the rear sole further having a bottom surface at least a portion of which is ground engaging, the ground-engaging portion of the bottom surface including at least one substantially planar portion and at least one portion non-planar with the at least one substantially planar portion, the at least one non-planar portion being positioned proximate a perimeter of the bottom surface and inclined upwardly in a direction toward the perimeter of the bottom surface from another portion of the bottom surface, the at least one non-planar portion having an outer edge coincident with the perimeter of the bottom surface and being located proximate the rearward portion of the rear sole;

a flexible plate having upper and lower surfaces and positioned between at least a portion of the rear sole and at least a portion of the heel region of the upper, peripheral portions of the plate being restrained from movement relative to an interior portion of the plate in a direction substantially perpendicular to a major axis of the shoe so that the interior portion of the plate is capable of being deflected relative to the peripheral portions in a direction substantially perpendicular to the major axis of the shoe, the upper surface of the plate being in at least substantial pad concave in shape, the interior portion of the plate being positioned over a void, and the lower surface of the plate being at least in part visible from outside of the shoe; and a sidewall that includes midsole material located beneath the plate, the sidewall having an exterior surface that is at least in part visible from outside the shoe and an interior surface that at least partially defines the void, the sidewall further having at least one opening therethrough on at least one of a lateral side of the shoe, a medial side of the shoe, and a rear of the shoe.

123. The shoe of claim 122, wherein the at least one opening is on both a medial side of the shoe and a lateral side of the shoe.

124. The shoe of claim 122, wherein at least one opening is on both a medial side of the shoe and a lateral side of the shoe, and on a rear of the shoe.

125. The shoe of claim 122, wherein the void is visible at least in part from outside the shoe through the at least one opening in the sidewall.

126. The shoe of claim 122, wherein the lower surface of the plate is visible at least in part from outside the shoe through the at least one opening in the sidewall.

127. The shoe of claim 122, wherein the interior surface of the sidewall is visible at least in part from outside the shoe through the at least one opening in the sidewall.

128. The shoe of claim 122, wherein at least one portion of a cross section of the plate perpendicular to a major axis of the shoe defines a curve in a direction generally from a medial side of the shoe to a lateral side of the shoe, at least one portion of a cross section of the plate parallel to the major axis of the shoe defining a curve in a direction generally from a front of the shoe to a back of the shoe.

129. The shoe of claim 122, wherein the at least one non-planar portion has a maximum linear dimension less than the greatest width of the bottom surface along a line perpendicular to a major axis of the shoe.

130. The shoe of claim 122, wherein the bottom surface includes an outsole material that is ground engaging, the rear sole including midsole material above the outsole material, at least a portion of the midsole material above the at least one non-planar portion being thinner than the midsole material above the at least one substantially planar portion of the bottom surface of the rear sole.

131. The shoe of claim 122, wherein the plate has at least one opening therein.

132. The shoe of claim 131, wherein the at least one opening has a center located beneath the approximate center of the heel of the user.

133. The shoe of claim 132, wherein the plate has multiple elongated cut-out portions therethrough.

134. The shoe of claim 133, wherein the elongated cut-out portions are oriented around the center of the opening.

135. The shoe of claim 134, wherein the elongated cut-out portions are evenly spaced around the center of the opening.

136. The shoe of claim 135, wherein the elongated cut-out portions have a length and are oriented around the center of the opening such that the length is in a direction away from the center of the opening and toward the periphery of the plate.

137. The shoe of claim 136, wherein a mid-longitudinal axis along the length of the elongated cut-out portions passes through the approximate center of the opening.

138. The shoe of claim 122, wherein a portion of the interior portion of the plate is thinner than a portion of the peripheral portions of the plate.

139. The shoe of claim 137, wherein the elongated cut-out portions are spaced around the center of the opening in a star-like pattern.

140. The shoe of claim 137, wherein the plate has six elongated cut-out portions around the center of the opening, the cut-out portions being oriented around the center of the opening in 60-degree increments.

141. The shoe of claim 131, wherein the at least one opening in the plate is at least in part visible from outside the shoe.

142. The shoe of claim 122, wherein the non-planar portion of the ground-engaging portion of the bottom surface of the rear sole includes an interior edge, the interior edge being located proximate an opening in the ground-engaging portion of the bottom surface.

143. The shoe of claim 142, wherein the interior edge is at least in part curved.

144. The shoe of claim 142, wherein the interior edge is at least in part arc-shaped.

145. The shoe of claim 142, wherein the interior edge defines at least a portion of a circle.

146. The shoe of claim 142, wherein the opening is substantially circular in shape.

147. The shoe of claim 142, wherein the rear sole has an interior sidewall adjacent and extending upwardly from the interior edge of the non-planar portion of the ground-engaging portion of the bottom surface.

148. The shoe of claim 142, wherein the interior edge defines a thickness of a layer of an outsole material, the outsole layer having an upper surface and a lower surface, the upper surface contacting another portion of the rear sole and the lower surface comprising at least a portion of the bottom surface of the rear sole.

149. The shoe of claim 142, wherein the opening in the ground-engaging portion of the bottom surface exposes a wall that defines, at least in part, a truncated cone.

150. The shoe of claim 122, wherein the peripheral portions of the flexible plate are restrained from movement relative to the interior portion along at least a substantial portion of the peripheral portions.

151. The shoe of claim 122, wherein the peripheral portions of the flexible plate are restrained from movement relative to the interior portion at a point along a medial side and at a point along a lateral side of the shoe.

152. The shoe of claim 122, wherein a forward facing portion and a rearward facing portion of the peripheral portions of the flexible plate are restrained from movement relative to the interior portion.

153. The shoe of claim 122, wherein the peripheral portions of the flexible plate are restrained from movement relative to the interior portion both at a point along a medial side and at a point along a lateral side of the shoe and along a forward facing portion and a rearward facing portion of the peripheral portions of the flexible plate.

154. The shoe of claim 122, wherein the peripheral portions of the flexible plate are restrained from movement relative to the interior portion both along at least a portion of a medial side and at least a portion of a lateral side of the shoe and on at least a portion of a forward facing portion and at least a portion of a rearward facing portion of the peripheral portions of the flexible plate.

155. The shoe of claim 122, wherein at least one of the peripheral portions of the plate being restrained from movement is along the upper surface of the plate and at least one of the peripheral portions of the plate being restrained from movement is along the lower surface of the plate.

156. The shoe of claim 155, wherein the peripheral portions are both toward the front of the shoe.

157. The shoe of claim 155, wherein the peripheral portions are both toward the back of the shoe.

158. The shoe of claim 155, wherein the peripheral portions are both on the lateral side of the shoe.

159. The shoe of claim 155, wherein the peripheral portions are both on the medial side of the shoe.

160. The shoe of claim 155, wherein the peripheral portions of the upper and lower surfaces are proximate one another.

161. The shoe of claim 160, where the capable of being deflected interior portion is located between the peripheral portions of the upper and lower surfaces and a point beneath a central portion of the heel region of the upper.

162. A shoe comprising:

an upper having a heel region and an arch region;

a rear sole having a rearward portion and an opposite forward portion connected below the heel region, the rear sole having a bottom surface, at least a portion of which is ground engaging, the bottom surface including at least one substantially planar portion and at least two portions non-planar with the at least one substantially planar portion, the non-planar portions being positioned proximate the perimeter of the rear sole and separated from each other by other portions of the bottom surface, each of the non-planar portions being inclined upwardly from another portion of the bottom surface in a direction toward the perimeter of the rear sole, one of the at least two non-planar portions being proximate the rearward portion of the rear sole, and the other of the at least two non-planar portions being proximate the forward portion of the rear sole;

a flexible plate having upper and lower surfaces and supported between at least a portion of the rear sole and at least a portion of the heel region of the upper, peripheral portions of the plate being restrained from movement relative to an interior portion of the plate in a direction substantially perpendicular to a major axis of the shoe so that the interior portion of the plate is capable of being deflected relative to the peripheral portions in a direction substantially perpendicular to the major axis of the shoe;

an opening in the bottom surface of the rear sole located beneath the interior portion of the plate to expose the interior portion of the plate from outside of the shoe; and an arch bridge integral with the plate, the arch bridge extending from a position proximate a forward portion of the plate, forward beneath at least a portion of the arch region of the upper, the arch bridge having a bottom surface that is at least in part visible from outside of the shoe.

163. The shoe of claim 162, further including at least one wall proximate at least a portion of the peripheral portions of the plate, the at least one wall being integral with the plate and extending in a downwardly direction from the plate, the downwardly extending wall contacting at least a portion of the rear sole, at least a portion of the downwardly extending wall being visible from outside of the shoe.

164. The shoe of claim 163, further including at least one wall proximate at least a portion of the peripheral portions of the plate, the at least one wall being integral with the plate and extending in an upwardly direction from the plate, at least a portion of the upwardly extending wall being visible from outside of the shoe..

165. The shoe of claim 162, further including at least one wall proximate at least a portion of the peripheral portions of the plate, the at least one wall being integral with the plate and extending in an upwardly direction from the plate, at least a portion of the upwardly extending wall being visible from outside of the shoe.

166. The shoe of claim 162, wherein a substantial portion of the bottom surface of the arch bridge is visible from outside of the shoe.

167. The shoe of claim 162, wherein the bottom surface of the arch bridge is visible on a line perpendicular to a major axis of the shoe across a width of the arch bridge.

168. The shoe of claim 162, wherein the arch bridge has proximate at least one of a medial side of the shoe and a lateral side of the shoe at least one wall integral with the arch bridge and extending in an upwardly direction.

169. The shoe of claim 168, wherein at least a portion of the upwardly extending wall of the arch bridge is connected to the arch region of the upper.

170. The shoe of claim 168, wherein at least a portion of the upwardly extending wall of the arch bridge is visible from outside of the shoe.

171. The shoe of claim 170, wherein the arch bridge has proximate at least one of a medial side of the shoe and a lateral side of the shoe at least one wall integral with the arch bridge and extending in a downwardly direction, at least a portion of the downwardly extending wall of the arch bridge being visible from outside of the shoe.

172. The shoe of claim 162, wherein the arch bridge has proximate at least one of a medial side of the shoe and a lateral side of the shoe at least one wall integral with the arch bridge and extending in a downwardly direction, at least a portion of the downwardly extending wall of the arch bridge being visible from outside of the shoe.

173. The shoe of claim 168, further including at least one wall proximate at least a portion of the peripheral portions of the plate, the at least one wall being integral with the plate and extending in an upwardly direction from the plate.

174. The shoe of claim 173, wherein the upwardly extending wall of the arch bridge is adjacent the upwardly extending wall of the plate.

175. The shoe of claim 173, wherein the upwardly extending wall of the arch bridge is integral with the upwardly extending wall of the plate.

176. The shoe of claim 175, wherein at least a portion of the upwardly extending wall of the arch bridge and at least a portion of the upwardly extending wall of the plate are visible from outside of the shoe.

177. The shoe of claim 162, wherein further comprising at least one sidewall above at least a portion of the bottom surface of the rear sole, the at least one sidewall having at least one hole therethrough located on at least one of a lateral side, a medial side, and a rear of the shoe.

178. The shoe of claim 177, wherein the at least one hole includes at least two holes, at least one of the at least two holes being on the medial side of the shoe and at least one of the at least two holes being on the lateral side of the shoe.

179. The shoe of claim 162, wherein a substantial portion of the peripheral portions of the flexible plate are restrained from movement relative to the interior portion of the flexible plate.

180. The shoe of claim 162, wherein the flexible plate has substantially its entire peripheral portion restrained.

181. The shoe of claim 162, wherein the peripheral portions of the flexible plate being restrained from movement relative to the interior portion are at a point along a medial side and at a point along a lateral side of the shoe.

182. The shoe of claim 162, wherein a forward facing portion and a rearward facing portion of the peripheral portions of the flexible plate are restrained from movement relative to the interior portion.

183. The shoe of claim 162, wherein the peripheral portions of the flexible plate are restrained from movement relative to the interior portion both at a point along a medial side and a lateral side of the shoe and along a forward facing portion and a rearward facing portion of the peripheral portion of the flexible plate.

184. The shoe of claim 162, wherein the peripheral portions of the flexible plate are restrained from movement relative to the interior portion both along at least a portion of a medial side and a lateral side of the shoe and on at least a portion of a forward facing portion and a rearward facing portion of the peripheral portion of the flexible plate.

185. The shoe of claim 162, wherein at least one of the peripheral portions of the plate being restrained from movement is along the upper surface of the plate and at least one of the peripheral portions of the plate being restrained from movement is along the lower surface of the plate.

186. The shoe of claim 185, wherein the peripheral portions are both toward the front of the shoe.

187. The shoe of claim 185, wherein the peripheral portions are both toward the back of the shoe.

188. The shoe of claim 185, wherein the peripheral portions arc both on the lateral side of the shoe.

189. The shoe of claim 185, wherein the peripheral portions are both on the medial side of the shoe.

190. The shoe of claim 185, wherein the peripheral portions of the upper and lower surfaces are proximate one another.

191. The shoe of claim 190, wherein the capable of being deflected interior portion is located between the peripheral portions of the upper and lower surfaces and a point beneath a central portion of the heel region of the upper.

192. A shoe comprising:

an upper having a heel region;

a rear sole secured below the heel region of the upper; and a flexible plate having upper and lower surfaces and supported between at least a portion of the rear sole and at least a portion of the heel region of the upper;

at least a portion of the periphery of the plate being restrained from movement in a substantially vertical direction relative to an interior portion so that the interior portion of the plate is capable of being deflected relative to at least a portion of the restrained periphery in a substantially vertical direction; and supporting structure located proximate the plate having at least one wall extending in a downward direction to at least partially define a recess, at least a portion of the rear sole secured in the recess of the supporting structure.

193. The shoe of claim 192, wherein the interior portion of the plate is positioned over a void.

194. The shoe of claim 193, wherein at least one portion of a cross section of the plate parallel to the major axis of the shoe defines a curve in a direction generally from a front of the shoe to a back of the shoe.

195. The shoe of claim 194, wherein the plate has an upper surface with at least two convex portions, at least a portion of the upper surface being concave, the concave portion of the upper surface being located between the two convex portions of the upper surface.

196. The shoe of claim 195, wherein the portion of the periphery of the plate being restrained from movement relative to the interior portion includes at at least two spaced apart points along a medial side of the shoe and at at least two spaced apart points along a lateral side of the shoe, the interior portion of the plate being located above a point between the at least two points along the medial side of the shoe and the at least two points along the lateral side of the shoe and beneath the approximate center of the users heel.

197. The shoe of claim 196, wherein upon the deflection of the interior portion of the plate, the at least two points along the medial side of the shoe and the at least two points along the lateral side of the shoe are displaceable in a direction substantially parallel to the ground.

198. The shoe of claim 196, wherein the upper has an arch region, and further comprising an arch bridge integral with the plate, the arch bridge extending from a position proximate a forward portion of the plate, forward beneath at least a portion of the arch region of the upper, the arch bridge having a bottom surface that is at least in part visible from outside of the shoe.

199. The shoe of claim 198, further comprising at least one sidewall above at least a portion of the bottom surface of the rear sole, the at least one sidewall having at least one hole therethrough located on at least one of a lateral side, a medial side, and a rear of the shoe.

200. The shoe of claim 199, further comprising at least one wall proximate at least a portion of the periphery of the plate and extending in at least one of an upwardly direction and a downwardly direction from the plate, the at least one wall being integral with the plate.

201. The shoe of claim 200, wherein at least one portion of the periphery of the plate being restrained from movement is along the upper surface of the plate and at least one other portion of the periphery of the plate being restrained from movement is along the lower surface of the plate.

202. The shoe of claim 201, wherein the portions of the periphery of the upper and lower surfaces being restrained from movement are proximate one another.

203. The shoe of claim 202, where the capable of being deflected interior portion is located between the portions of the periphery of the upper and lower surfaces being restrained and a point beneath a central portion of the heel region of the upper.

204. A shoe comprising:

an upper having a heel region;

a rear sole secured below the heel region and having rearward portion, the rear sole further having a bottom surface at least a portion of which is ground engaging, the ground-engaging portion of the bottom surface including at least one substantially planar portion and at least one portion non-planar with the at least one substantially planar portion, the at least one non-planar portion being positioned proximate a perimeter of the bottom surface and inclined upwardly in a direction toward the perimeter of the bottom surface from another portion of the bottom surface, the at least one non-planar portion having an outer edge coincident with the perimeter of the bottom surface and being located proximate the rearward portion of the rear sole;

a flexible plate having upper and lower surfaces and positioned between at least a portion of the rear sole and at least a portion of the heel region of the upper, peripheral portions of the plate being restrained from movement relative to an interior portion of the plate in a direction substantially perpendicular to a major axis of the shoe so that the interior portion of the plate is capable of being deflected relative to the peripheral portions in a direction substantially perpendicular to the major axis of the shoe, at least a portion of at least one cross-section of the plate defining a curve, the interior portion of the plate being positioned over a void, and the lower surface of the plate being at least in part visible from outside of the shoe, the plate having at least one opening therein, the at least one opening having a center located beneath the approximate center of the user's heel; and a sidewall that includes midsole material located beneath the plate, the sidewall having an exterior surface that is at least in pad visible from outside the shoe and an interior surface that at least partially defines the void, the sidewall further having at least one opening therethrough on at least one of a lateral side of the shoe, a medial side of the shoe, and a rear of the shoe.

205. The shoe of claim 204, wherein the at least one opening in the sidewall is on both a medial side of the shoe and a lateral side of the shoe.

206. The shoe of claim 204, wherein the at least one opening in the sidewall is on both a medial side of the shoe and a lateral side of the shoe, and on a rear of the shoe.

207. The shoe of claim 204, wherein the void is visible at least in part from outside the shoe through the at least one opening in the sidewall.

208. The shoe of claim 204, wherein the lower surface of the plate is visible at least in part from outside the shoe through the at least one opening in the sidewall.

209. The shoe of claim 204, wherein the interior surface of the sidewall is visible at least in part from outside the shoe through the at least one opening in the sidewall.

210. The shoe of claim 204, wherein the at least one non-planar portion has a maximum linear dimension less than the greatest width of the bottom surface along a line perpendicular to a major axis of the shoe.

211. The shoe of claim 204, wherein the bottom surface includes an outsole material that is ground engaging, the rear sole including midsole material above the outsole material, at least a portion of the midsole material above the at least one non-planar portion being thinner than the midsole material above the at least one substantially planar portion of the bottom surface of the rear sole.

212. The shoe of claim 204, wherein the plate has multiple elongated cut-out portions therethrough.

213. The shoe of claim 212, wherein the elongated cut-out portions are oriented around the center of the opening.

214. The shoe of claim 213, wherein the elongated cut-out portions are evenly spaced around the center of the opening.

215. The shoe of claim 214, wherein the elongated cut-out portions have a length and are oriented around the center of the opening such that the length is in a direction away from the center of the opening and toward the periphery of the plate.

216. The shoe of claim 215, wherein a mid-longitudinal axis along the length of the elongated cut-out portions passes through the approximate center of the opening.

217. The shoe of claim 204, wherein a portion of the interior portion of the plate is thinner than a portion of the peripheral portions of the plate.

218. The shoe of claim 216, wherein the elongated cut-out portions are spaced around the center of the opening in a star-like pattern.

219. The shoe of claim 216, wherein the plate has six elongated cut-out portions around the center of the opening, the cut-out portions being oriented around the center of the opening in 60-degree increments.

220. The shoe of claim 204, wherein the at least one opening in the plate is at least in part visible from outside the shoe.

221. The shoe of claim 204, wherein the non-planar portion of the ground-engaging portion of the bottom surface of the rear sole includes an interior edge, the interior edge being located proximate an opening in the ground-engaging portion of the bottom surface.

222. The shoe of claim 221, wherein the interior edge is at least in part curved.

223. The shoe of claim 221, wherein the interior edge is at least in part arc-shaped.

224. The shoe of claim 221, wherein the interior edge defines at least a portion of a circle.

225. The shoe of claim 221, wherein the opening is substantially circular shape.

226. The shoe of claim 221, wherein the rear sole has an interior sidewall adjacent and extending upwardly from the interior edge of the non-planar portion of the ground-engaging portion of the bottom surface.

227. The shoe of claim 221, wherein the interior edge defines a thickness of a layer of an outsole material, the outsole layer having an upper surface and a lower surface, the upper surface contacting another portion of the rear sole and the lower surface comprising at least a portion of the bottom surface of the rear sole.

228. The shoe of claim 221, wherein the opening in the ground-engaging portion of the bottom surface exposes a wall that defines, at least in part, a truncated cone.

229. The shoe of claim 204, wherein the peripheral portions of the flexible plate are restrained from movement relative to the interior portion at a point along a medial side and at a point along a lateral side of the shoe.

230. The shoe of claim 204, wherein a forward facing portion and a rearward facing portion of the peripheral portions of the flexible plate are restrained from movement relative to the interior portion.

231. The shoe of claim 204, wherein the peripheral portions of the flexible plate are restrained from movement relative to the interior portion both at a point along a medial side and at a point along a lateral side of the shoe and along a forward facing portion and a rearward facing portion of the peripheral portions of the flexible plate.

232. The shoe of claim 204, wherein the peripheral portions of the flexible plate are restrained from movement relative to the interior portion both along at least a portion of a medial side and at least a portion of a lateral side of the shoe and on at least a portion of a forward facing portion and at least a portion of a rearward facing portion of the peripheral portions of the flexible plate.

233. The shoe of claim 204, wherein at least one of the peripheral portions of the plate being restrained from movement is along the upper surface of the plate and at least one of the peripheral portions of the plate being restrained from movement is along the lower surface of the plate.

234. The shoe of claim 233, wherein the peripheral portions are both toward the front of the shoe.

235. The shoe of claim 233, wherein the peripheral portions are both toward the back of the shoe.

236. The shoe of claim 233, wherein the peripheral portions are both on the lateral side of the shoe.

237. The shoe of claim 233, wherein the peripheral portions are both on the medial side of the shoe.

238. The shoe of claim 233, wherein the peripheral portions of the upper and lower surfaces are proximate one another.

239. The shoe of claim 238, wherein the capable of being deflected interior portion is located between the peripheral portions of the upper and lower surfaces and a point beneath a central portion of the heel region of the upper.

* * * * *

UNITED STATES PATENT AND TRADEMARK OFFICE

CERTIFICATE OF CORRECTION

PATENT NO. : 6,604,300 B2
DATED : August 12, 2003
INVENTOR(S) : David F. Meschan It is certified that error appears in the above-identified patent and that said Letters Patent is hereby corrected as shown below:

Title page,
Item [56], References Cited, OTHER PUBLICATIONS, insert the following:
-- AVIA 1989 Catalog excerpt.
AVIA Fall 1991 Footwear Catalog.
Runner's World 1989 Spring Shoe Survey (MIZ 135893 – MIZ 135902).
4 photographs of shoes sold in the United States prior to the filing date of the above-referenced application. --; and at the third reference, change "Etoni" to -- Etonic --.

Column 16,
Line 67, change "pad" to -- part --.

Column 17,
Line 11, change "non- planar" to -- non-planar --; and
Line 51, change "users" to -- user's --.

Column 18,
Line 47, change "pad" to -- part --.

Column 19,
Line 30, change "non- planar" to -- non-planar --.

Column 20,
Line 58, change "plate ,the" to -- plate, the --.

Column 21,
Line 5, change "non- planar" to -- non-planar --;
Line 12, change "sole." to -- sole, --; and
Line 32, change "non- planar" to -- non-planar --.

Column 24,
Line 6, change "pad" to -- part --.

Column 26,
Line 14, change "where" to -- wherein --.

Column 27,
Line 2, change "shoe.." to -- shoe. --; and
Line 51, delete "wherein".

Column 28,
Line 29, change "arc" to -- are --.

UNITED STATES PATENT AND TRADEMARK OFFICE

CERTIFICATE OF CORRECTION

PATENT NO. : 6,604,300 B2 
DATED : August 12, 2003
INVENTOR(S) : David F. Meschan It is certified that error appears in the above-identified patent and that said Letters Patent is hereby corrected as shown below:

Column 29,
Line 9, change "users" to -- user's --; and
Line 40, change "where" to -- wherein --.

Column 30,
Line 13, change "pad" to -- part --.

Column 31,
Line 16, after "circular" insert -- in --.

Signed and Sealed this

Ninth Day of December, 2003

JAMES E. ROGAN
*Director of the United States Patent and Trademark Office*